US006479943B2

(12) United States Patent
Shigeta et al.

(10) Patent No.: US 6,479,943 B2
(45) Date of Patent: Nov. 12, 2002

(54) DISPLAY PANEL DRIVING METHOD

(75) Inventors: Tetsuya Shigeta, Nakakoma-gun (JP); Tetsuro Nagakubo, Nakakoma-gun (JP); Hirofumi Honda, Nakakoma-gun (JP)

(73) Assignee: Pioneer Corporation, Tokyo (JP)

( * ) Notice: Subject to any disclaimer, the term of this patent is extended or adjusted under 35 U.S.C. 154(b) by 36 days.

(21) Appl. No.: 09/829,010

(22) Filed: Apr. 10, 2001

(65) Prior Publication Data

US 2002/0030671 A1 Mar. 14, 2002

(30) Foreign Application Priority Data

Apr. 11, 2000 (JP) ..... 2000-109199

(51) Int. Cl.[7] ..... G09G 3/10; G09G 3/28

(52) U.S. Cl. ..... 315/169.4; 315/169.1; 345/60

(58) Field of Search ..... 315/169.1, 169.2, 315/169.3, 169.4; 345/55, 76, 77, 79, 102

(56) References Cited

U.S. PATENT DOCUMENTS 5,854,540 A * 12/1998 Matsumoto et al. ..... 315/169.1
5,963,184 A * 10/1999 Tokunaga et al. ..... 315/169.4
6,037,916 A * 3/2000 Amemiya ..... 316/169.4
6,144,163 A * 11/2000 Amemiya et al. ..... 315/169.1
6,175,194 B1 * 1/2001 Saegusa et al. ..... 315/169.4
6,211,865 B1 * 4/2001 Hosoi et al. ..... 315/169.1
6,384,802 B1 * 5/2002 Moon ..... 315/169.1
6,414,653 B1 * 7/2002 Kobayashi ..... 315/169.4

* cited by examiner

*Primary Examiner*—Don Wong
*Assistant Examiner*—Minh D A
(74) *Attorney, Agent, or Firm*—Sughrue Mion, PLLC

(57) ABSTRACT

A display panel driving method sequentially writes pixel data of every display line into pixel cells on display lines belonging to a region other than a black display region on a screen, while the method stops writing pixel data into pixel cells on display lines belonging to the black display region or simultaneously sets the pixel cells into a non-light emitting cell state. Since a time spent for each pixel data writing process in one field is reduced, a light emission period (number of times) allocated to each light emission sustain process is increased, or the number of subfields is increased by the reduction in time, thereby making it possible to improve the quality of a displayed image.

11 Claims, 22 Drawing Sheets

FIG. 4

| GRADATION LEVEL | PIXEL DATA | LIGHT EMISSION PATTERN | | | | LUMINANCE |
|---|---|---|---|---|---|---|
| | | SF1 | SF2 | SF3 | SF4 | |
| 1 | 1 1 1 1 | ● | ● | ● | ● | 0 |
| 2 | 0 1 1 1 | ○ | ● | ● | ● | 1 |
| 3 | 1 0 1 1 | ● | ○ | ● | ● | 2 |
| 4 | 0 0 1 1 | ○ | ○ | ● | ● | 3 |
| 5 | 1 1 0 1 | ● | ● | ○ | ● | 4 |
| 6 | 0 1 0 1 | ○ | ● | ○ | ● | 5 |
| 7 | 1 0 0 1 | ● | ○ | ○ | ● | 6 |
| 8 | 0 0 0 1 | ○ | ○ | ○ | ● | 7 |
| 9 | 1 1 1 0 | ● | ● | ● | ○ | 8 |
| 10 | 0 1 1 0 | ○ | ● | ● | ○ | 9 |
| 11 | 1 0 1 0 | ● | ○ | ● | ○ | 10 |
| 12 | 0 0 1 0 | ○ | ○ | ● | ○ | 11 |
| 13 | 1 1 0 0 | ● | ● | ○ | ○ | 12 |
| 14 | 0 1 0 0 | ○ | ● | ○ | ○ | 13 |
| 15 | 1 0 0 0 | ● | ○ | ○ | ○ | 14 |
| 16 | 0 0 0 0 | ○ | ○ | ○ | ○ | 15 |

○ LIGHT EMISSION

● NON-LIGHT EMISSION
(SF IN WHICH SELECTIVE ERASURE DISCHARGE IS PRODUCED)

FIG. 10

| GRADATION LEVEL | PIXEL DATA PD | LIGHT EMISSION PATTERN | | | | LUMINANCE | |
|---|---|---|---|---|---|---|---|
| | | SF1 | SF2 | SF3 | SF4 | A | B |
| 1 | 0 0 0 0 | ● | ● | ● | ● | 0 | 0 |
| 2 | 0 0 0 1 | ○ | ● | ● | ● | 1 | 2 |
| 3 | 0 0 1 0 | ● | ○ | ● | ● | 2 | 4 |
| 4 | 0 0 1 1 | ○ | ○ | ● | ● | 3 | 6 |
| 5 | 0 1 0 0 | ● | ● | ○ | ● | 4 | 8 |
| 6 | 0 1 0 1 | ○ | ● | ○ | ● | 5 | 10 |
| 7 | 0 1 1 0 | ● | ○ | ○ | ● | 6 | 12 |
| 8 | 0 1 1 1 | ○ | ○ | ○ | ● | 7 | 14 |
| 9 | 1 0 0 0 | ● | ● | ● | ○ | 8 | 16 |
| 10 | 1 0 0 1 | ○ | ● | ● | ○ | 9 | 18 |
| 11 | 1 0 1 0 | ● | ○ | ● | ○ | 10 | 20 |
| 12 | 1 0 1 1 | ○ | ○ | ● | ○ | 11 | 22 |
| 13 | 1 1 0 0 | ● | ● | ○ | ○ | 12 | 24 |
| 14 | 1 1 0 1 | ○ | ● | ○ | ○ | 13 | 26 |
| 15 | 1 1 1 0 | ● | ○ | ○ | ○ | 14 | 28 |
| 16 | 1 1 1 1 | ○ | ○ | ○ | ○ | 15 | 30 |

○ LIGHT EMISSION

● NON-LIGHT EMISSION

FIG. 18

[SELECTIVE ERASURE]

| CONVERSION TABLE FOR DATA CONVERTER UNIT 51 | | | | | | | | | | | | | | | | LIGHT EMISSION DRIVING PATTERN | | | | | | | | | | | | | | | LUMINANCE | |
|---|---|---|---|---|---|---|---|---|---|---|---|---|---|---|---|---|---|---|---|---|---|---|---|---|---|---|---|---|---|---|---|---|
| PD | GDa 1 | 2 | 3 | 4 | 5 | 6 | 7 | 8 | 9 | 10 | 11 | 12 | 13 | 14 | 15 | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 | • | • |
| 0000 | 1 | 0 | 0 | 0 | 0 | 0 | 0 | 0 | 0 | 0 | 0 | 0 | 0 | 0 | 0 | ● | | | | | | | | | | | | | | | 0 | 0 |
| 0001 | 0 | 1 | 0 | 0 | 0 | 0 | 0 | 0 | 0 | 0 | 0 | 0 | 0 | 0 | 0 | ○ | ● | | | | | | | | | | | | | | 2 | 4 |
| 0010 | 0 | 0 | 1 | 0 | 0 | 0 | 0 | 0 | 0 | 0 | 0 | 0 | 0 | 0 | 0 | ○ | ○ | ● | | | | | | | | | | | | | 4 | 8 |
| 0011 | 0 | 0 | 0 | 1 | 0 | 0 | 0 | 0 | 0 | 0 | 0 | 0 | 0 | 0 | 0 | ○ | ○ | ○ | ● | | | | | | | | | | | | 6 | 12 |
| 0100 | 0 | 0 | 0 | 0 | 1 | 0 | 0 | 0 | 0 | 0 | 0 | 0 | 0 | 0 | 0 | ○ | ○ | ○ | ○ | ● | | | | | | | | | | | 8 | 16 |
| 0101 | 0 | 0 | 0 | 0 | 0 | 1 | 0 | 0 | 0 | 0 | 0 | 0 | 0 | 0 | 0 | ○ | ○ | ○ | ○ | ○ | ● | | | | | | | | | | 10 | 20 |
| 0110 | 0 | 0 | 0 | 0 | 0 | 0 | 1 | 0 | 0 | 0 | 0 | 0 | 0 | 0 | 0 | ○ | ○ | ○ | ○ | ○ | ○ | ● | | | | | | | | | 12 | 24 |
| 0111 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 14 | 28 |
| 1000 | 0 | 0 | 0 | 0 | 0 | 0 | 0 | 0 | 1 | 0 | 0 | 0 | 0 | 0 | 0 | ○ | ○ | ○ | ○ | ○ | ○ | ○ | ○ | ● | | | | | | | 16 | 32 |
| 1001 | 0 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ○ | ● | | | | | | 18 | 36 |
| 1010 | 0 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ○ | ● | | | | | 20 | 40 |
| 1011 | 0 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ○ | ● | | | | 22 | 44 |
| 1100 | 0 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ○ | ● | | | 24 | 48 |
| 1101 | 0 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ○ | ● | | 26 | 52 |
| 1110 | 0 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ○ | ● | 28 | 56 |
| 1111 | 0 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | 30 | 60 |

WHEN DRIVEN IN ACCORDANCE WITH FORMAT OF FIG. 20

WHEN DRIVEN IN ACCORDANCE WITH FORMAT OF FIG. 21

BLACK CIRCLE : SELECTIVE ERASURE DISCHARGE

WHITE CIRCLE : LIGHT EMISSION

FIG. 19

[SELECTIVE ERASURE]

| CONVERSION TABLE FOR DATA CONVERTER UNIT 53 | | | | | | | | | | | | | | | | LIGHT EMISSION DRIVING PATTERN | | | | | | | | | | | | | | | LUMINANCE |
|---|---|---|---|---|---|---|---|---|---|---|---|---|---|---|---|---|---|---|---|---|---|---|---|---|---|---|---|---|---|---|---|
| PD | GDb 1 | 2 | 3 | 4 | 5 | 6 | 7 | 8 | 9 | 10 | 11 | 12 | 13 | 14 | 15 | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 | |
| 0000 | 1 | 0 | 0 | 0 | 0 | 0 | 0 | 0 | 0 | 0 | 0 | 0 | 0 | 0 | 0 | ● | | | | | | | | | | | | | | | 0 |
| 0001 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0010 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0011 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0100 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0101 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0110 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 0111 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1000 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1001 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1010 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1011 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1100 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1101 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1110 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |
| 1111 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | | 28 |

BLACK CIRCLE : SELECTIVE ERASURE DISCHARGE
WHITE CIRCLE : LIGHT EMISSION

DISPLAY PANEL DRIVING METHOD

BACKGROUND OF THE INVENTION

1. Field of the Invention

The present invention relates to a method for driving a plasma display panel in a matrix display scheme.

2. Description of the Related Art

At present, as thin display devices, AC (alternate current discharge) type plasma display panels (hereinafter referred to as the "PDP") are commercially available in the market.

The AC type PDP comprises a plurality of column electrodes and a plurality of pairs of row electrodes which are arranged orthogonal to the column electrodes and form respective scanning lines in pair. The respective row electrode pairs and column electrodes are covered with a dielectric material defining a discharge space, and are constructed to form a discharge cell corresponding to one pixel at the intersection of each row electrode pair and each column electrode. In this event, since the PDP utilizes a discharge phenomenon, the discharge cells only have two states, i.e., a "light emission" state and a "non-light emission" state. Thus, a subfield method is typically employed to realize gradation luminance representations in the PDP.

In the subfield method, one field display period is made up of N subfields each of which corresponds to each of N bits in pixel data corresponding to an input video signal. Each of these N subfields is allocated a number of times of light emission (a light emission period) corresponding to a weighting for each bit digit in the pixel data to drive each discharge cell to emit light.

FIG. 1 is a diagram generally illustrating the configuration of a plasma display device which employs the subfield method as mentioned to drive the PDP in gradation representation.

In FIG. 1, a driver 100 converts an input video signal to digital pixel data corresponding to each of pixels, and applies pixel data pulses corresponding to the pixel data to column electrodes $D_1$–$D_m$ of a PDP 10 which is employed as a plasma display panel. The driver 100 further applies a variety of driving pulses as described below to row electrodes $X_1$–$X_n$ and $Y_1$–$Y_n$. One display line of the PDP 10 is comprised of a pair of row electrodes X, Y which are formed to intersect the column electrodes $D_1$–$D_m$, respectively. These column electrodes and row electrodes are formed with a dielectric material, not shown, interposed therebetween, and one pixel cell is formed at an intersection of a column electrode with a row electrode pair.

FIG. 2 is a diagram illustrating an example of a light emission driving format with which the driver 100 drives the DPD in one field period.

In the light emission driving format illustrated in FIG. 2, one field display period is divided into four subfields SF1–SF4. Then, in each of the subfields, a simultaneous reset process Rc, a pixel data writing process Wc, a light emission sustaining process Ic, and an erasure process E are performed, respectively.

FIG. 3 illustrates application timings (within one subfield) at which the driver 100 applies the column electrodes and row electrode pairs of the PDP 10 with a variety of driving pulses for performing each of the processes.

First, in the simultaneous reset process Rc, the driver 100 simultaneously applies a reset pulse $RP_X$ of negative polarity and a reset pulse $RP_Y$ of positive polarity to the row electrodes $X_1$–$X_N$ and $Y_1$–$Y_N$, respectively. In response to the applied reset pulses $RP_X$ and $RP_Y$, all discharge cells in the PDP 10 are discharged or reset to uniformly form a wall charge of a predetermined amount within the respective discharge cells. In this way, all the discharge cells are once initialized to "light emitting cells."

Next, in the pixel data writing process Wc, the driver 100 first converts an input video signal to 4-bit pixel data. The first bit of the pixel data is used in the pixel data writing process Wc in the subfield SF1; the second bit in SF2; the third bit in SF3; and the fourth bit in SF4, respectively, and the following processing is performed. For example, in the pixel data writing process Wc in the subfield SF1, a pixel data pulse at a high voltage is generated when the first bit of pixel data is at logical level "1", and the pixel data pulse at a low voltage (zero volt) is generated when the first bit is at logical level "0." Then, the driver 100 sequentially applies the column electrodes $D_1$–$D_m$ as illustrated in FIG. 3 with a group of pixel data pulses $PD_1$, $PD_2$, PD3, . . . , $PD_n$, each of which is comprised of m pixel data pulses, each corresponding to the first to n-th display lines in the PDP 10. Further, the driver 100 generates a scanning pulse SP of negative polarity as illustrated in FIG. 3 and sequentially applies the scanning pulse SP to the row electrodes $Y_1$–$Y_n$ at the same timing at which the group of pixel data pulses DP are each applied. Here, a discharge occurs only in discharge cells at intersections of the "rows" applied with the scanning pulse SP with the "columns" applied with the pixel data pulses at the high voltage (selective erasure discharge), thereby selectively erasing the wall charges which have remained in the discharge cells. The selective erasure discharge as mentioned causes the discharge cells initialized to "light emission cells" in the simultaneous reset process Rc to transition to "non-light emitting cells." On the other hand, the selective erasure discharge does not occur in discharge cells which has been applied with the pixel data pulse at the low voltage simultaneously with the scanning pulse SP, so that these cells maintain the state of "light emitting cells."

Next, in the light emission sustain process Ic, the driver 100 alternately applies the row electrodes $X_1$–$X_n$ and $Y_1$–$Y_n$ with sustain pulses $IP_X$ and $IP_Y$ as illustrated in FIG. 3. Here, the number of times (period) the sustain pulses $IP_X$ and $IP_Y$ are applied in each light emission sustaining process Ic has been set corresponding to a weighting factor allocated to each subfield.

For example, as illustrated in FIG. 2, the driver 100 repeatedly applies the row electrodes $X_1$–$X_n$ and $Y_1$–$Y_n$ with the sustain pulses $IP_X$ and $IP_Y$ the following number of times (period) in continuation:

SF1: 1
SF2: 2
SF3: 4
SF4: 8

In this event, only discharge cells in which the wall charges remain after the end of the pixel data writing process Wc, i.e., the "light emitting cells" discharge to emit light each time they are applied with the sustain pulses $IP_X$ and $IP_Y$ to sustain the light emitting state the number of times (period) as mentioned above.

Next, in the erasure process E, the driver 100 applies the row electrodes $X_1$–$X_n$ with an erasure pulse EP as illustrated in FIG. 3 to simultaneously discharge all the discharge cells for erasure, thereby erasing the wall charges remaining in the respective discharge cells.

FIG. 4 is a table showing all possible patterns of light emission driving performed within one field period in a gradation driving mode which utilizes the subfield method.

For example, when a video signal corresponding to luminance "5" (corresponding to pixel data "0101") is supplied, light is emitted in subfields SF1 and SF3 within SF1–SF4 as illustrated in FIG. 4. In this way, light is emitted once in SF1 and four times in SF3, i.e., a total of five times, so that an intermediate luminance corresponding to the luminance "5" is viewed. In other words, an intermediate luminance display at 16 gradation levels is implemented in a luminance range from luminance "0" to luminance "15" as shown in FIG. 4 by the gradation driving mode using the four subfields SF1–SF4, as described above.

In this event, as one field display period is divided into an increased number of subfields, a display image of higher quality is provided. Also, as the number of times the sustain pulses are applied is increased generally in each light emission sustain process Ic, a higher luminance display can be achieved.

However, since one field display period is regulated, it is not possible to thoughtlessly increase the number of times the sustain pulses are applied in each light emission sustain process Ic and the number of subfields into which one field display period is divided.

OBJECT AND SUMMARY OF THE INVENTION

It is an object of the present invention to provide a method of driving a plasma display panel which is capable of increasing the number of gradation levels or the luminance in driving the plasma display panel to display in gradation representation using the subfield method.

A display panel driving method according to the present invention is provided for driving a display panel having pixel cells formed at each of intersections of a plurality of row electrodes corresponding to display lines with a plurality of column electrodes arranged to intersect the row electrodes to provide a display in gradation representation in accordance with a video signal. The method performs, in each of a plurality of divided display periods of a unit display period in the video signal, a pixel data writing process for setting each of the pixel cells to either a light emitting cell or a non-light emitting cell in accordance with pixel data corresponding to the video signal to write the pixel data, and a light emission sustain process for causing only the light emission cells to emit light a number of times of light emission allocated thereto corresponding to a weighting factor applied to each of the divided display periods. The pixel data of every display line is sequentially written into each of the pixel cells on display lines belonging to a first display region in a display screen on the display panel, whereas for each of the pixel cells on display lines belonging to a second display region in the display screen, the writing of the pixel data is stopped, or the pixel cells are simultaneously set into the non-light emitting cell state.

BRIEF DESCRIPTION OF THE DRAWINGS

FIG. 4 is a table showing exemplary light emission driving patterns in accordance with the subfield method;

FIG. 10 is a table showing a correspondence of light emission patterns in accordance with pixel data PD to intermediate luminance levels generated by the respective light emission patterns;

FIG. 18 is a diagram showing a conversion table for a data converting circuit 51 and intermediate luminance levels which are generated for the respective light emission driving patterns;

FIG. 19 is a diagram showing a conversion table for a data converting circuit 53 and intermediate luminance levels which are generated for the respective light emission driving patterns;

DETAILED DESCRIPTION OF THE EMBODIMENTS

In the following, embodiments of the present invention will be described with reference to the accompanying drawings.

Figure 1:
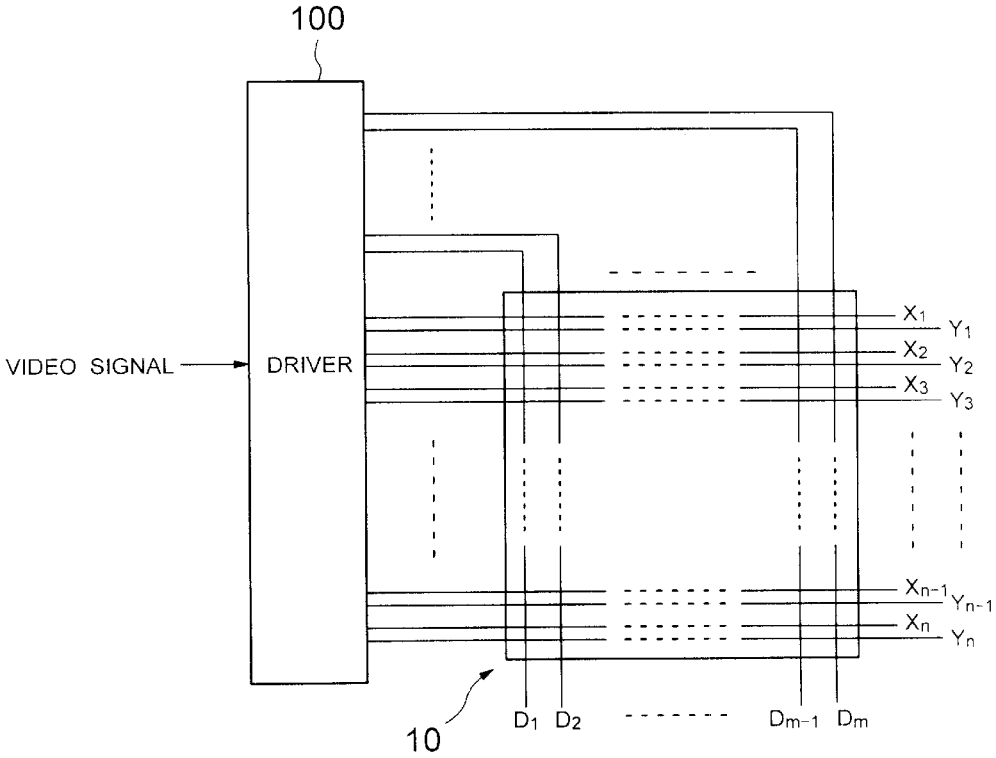
FIG. 1 is a schematic diagram generally illustrating the configuration of a plasma display device.
Figure 2:
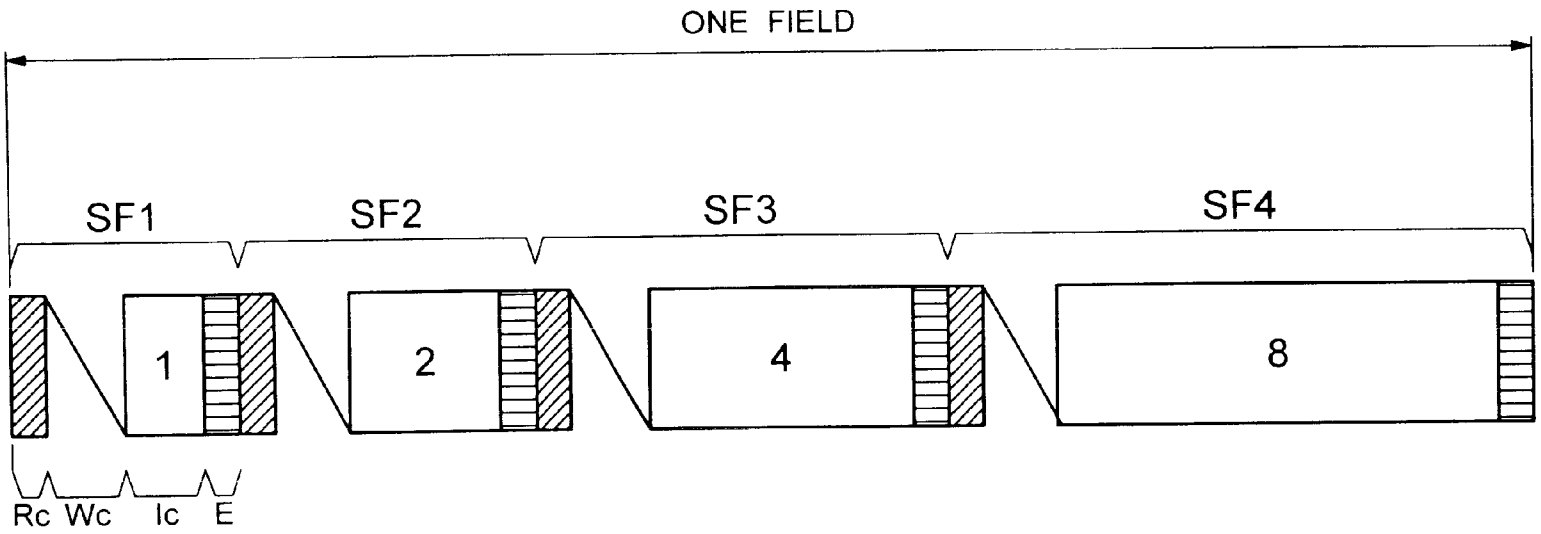
FIG. 2 is a diagram illustrating an example of a light emission driving format based on a subfield method.
Figure 3:
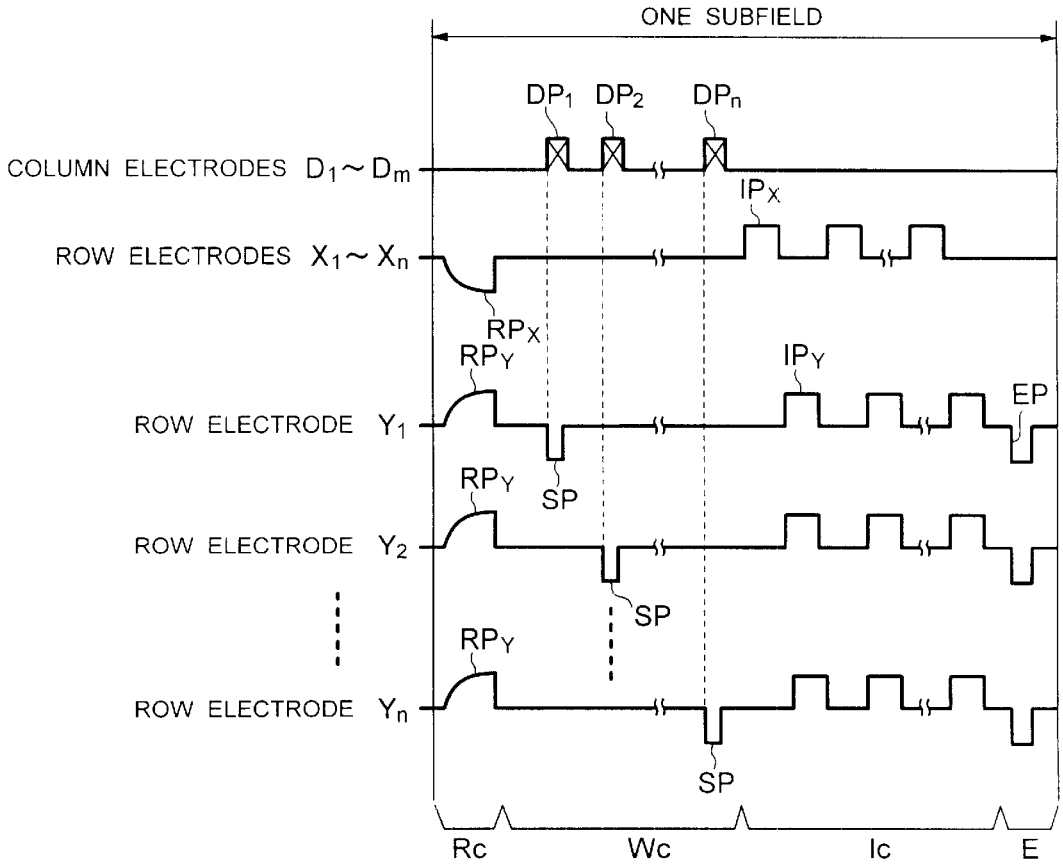
FIG. 3 is a waveform diagram showing exemplary application timings at which driving pulses are applied to a PDP 10.
Figure 5:
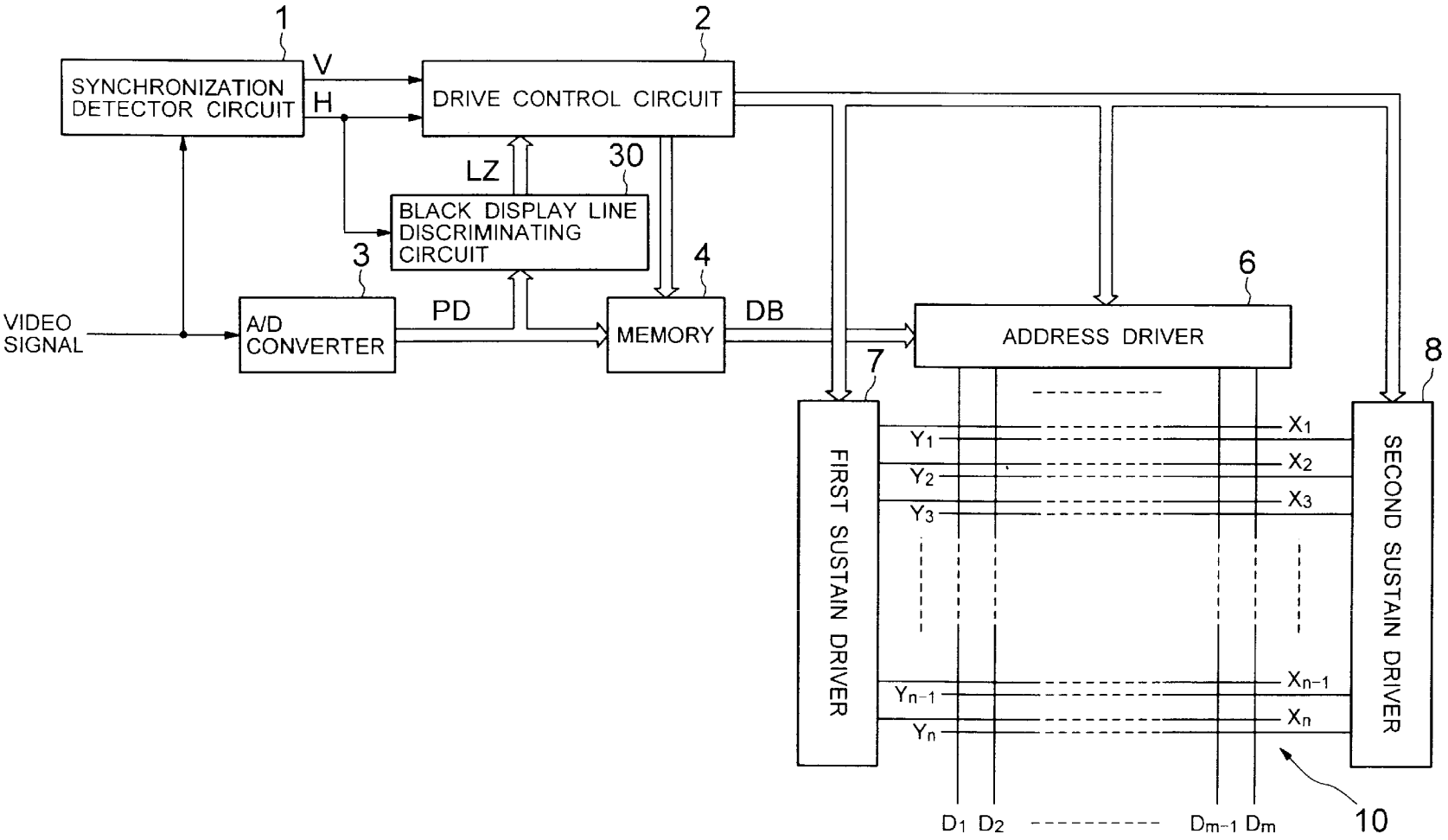
FIG. 5 is a block diagram illustrating the configuration of a plasma display device which drives a plasma display panel in accordance with a driving method according to the present invention.

FIG. 5 is a block diagram illustrating the configuration of a plasma display device which drives a plasma display panel in gradation representation in accordance with a driving method according to the present invention.

As illustrated in FIG. 5, the plasma display device comprises a PDP 10 as a plasma display panel and a variety of functional modules for driving the PDP 10.

The PDP 10 comprises m column electrodes $D_1$–$D_m$ as address electrodes, and n row electrodes $X_1$–$X_n$ and row electrodes $Y_1$–$Y_n$ which are arranged to intersect these column electrodes. In the PDP 10, a row electrode for one line of the screen is formed of a pair of a row electrode X and a row electrode Y. The column electrode D and the low electrode pairs X, Y are covered with a dielectric layer defining a discharge space, and a discharge cell corresponding to one pixel is formed at an intersection of each row electrode pair with each column electrode.

A synchronization detector circuit 1 generates a vertical synchronization detecting signal V when it detects a vertical synchronization signal from an input video signal, and supplies the signal V to a drive control circuit 2. Further, the synchronization detector circuit 1 generates a horizontal synchronization detecting signal H when it detects a horizontal synchronization signal from the input video signal, and supplies the signal H to each of the drive control circuit 2 and a black display line detector circuit 30.

An A/D converter 3 samples the input video signal for conversion to a 4-bit pixel data PD, for example, representative of a luminance level for each pixel, and supplies the pixel data PD to each of the black display line detector circuit 30 and a memory 4.

The black display line detector circuit 30 accumulates the pixel data PD every display line, and determines that a display line has a luminance level "0," i.e., a black display line when the result of accumulation for the display line is "0." Then, the black display line detector circuit 30 supplies the drive control circuit 2 with a black display line signal LZ indicative of the number of a display line which is determined as a black display line.

Figure 6:
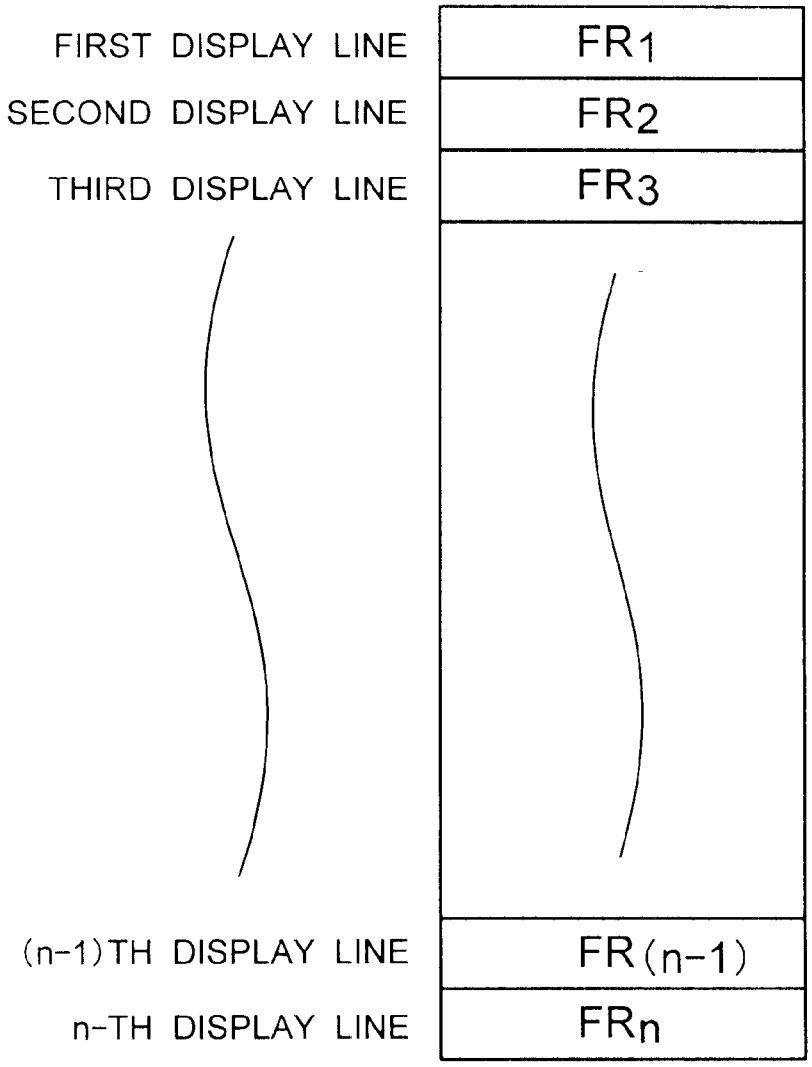
FIG. 6 is a diagram showing flag registers $FR_1$–$FR_n$.

The drive control circuit 2 is equipped with flag registers $FR_1$–$FR_n$ corresponding to first to n-th display lines, respectively, in the PDP 10, as shown in FIG. 6. These flag registers $FR_1$–$FR_n$ store logical level "0" as an initial value. When the drive control circuit 2 is supplied with the black display line signal LZ as mentioned above from the black display line detector circuit 30, the drive control circuit 2 rewrites the contents of the flag register RF corresponding to a display line indicated by the supplied black display line signal LZ to logical level "1." The drive control circuit 2 initializes the contents stored in each of the flag registers $FR_1$–$FR_n$ to logical level "0" each time an update operation for the flag registers $FR_1$–$FR_n$ is completed for the pixel data PD of one screen.

Further, the drive control circuit 2 supplies the memory 4 with a write signal for writing the pixel data PD, and also supplies the memory 4 with a read address and a read signal for sequentially reading pixel data written into the memory 4 from those belonging to a first display line to those belonging to an n-th display line. However, if any of the flag registers $FR_1$–$FR_n$ stores logical level "1," the drive control circuit 2 does not generate a read address for reading pixel data belonging to a display line corresponding to the flag register. In other words, the drive control circuit 2 inhibits pixel data corresponding to a display line determined as displaying a black image at luminance level "0" from being read from the memory 4.

The memory 4 sequentially stores the pixel data PD supplied from the A/D converter 3 in response to the write signal supplied from the drive control circuit 2. Then, the memory 4 performs a read operation as described below when it finishes writing one screen of pixel data, i.e., (nxm) pixel data PD from pixel data $PD_{11}$ corresponding to a pixel at the first row, first column to pixel data $PD_{nm}$ corresponding to a pixel at an n-th row, m-th column.

First, the memory 4 regards the first bit of each pixel data $PD_{11}$–$PD_{nm}$ as a drive pixel data bit $DB1_{11}$–$DB1_{nm}$, and reads these drive pixel data bits on a display line basis in accordance with the read address supplied from the drive control circuit 2, and supplies the drive pixel data bits to an address driver 6. Next, the memory 4 regards the second bit of each pixel data $PD_{11}$–$PD_{nm}$ as a drive pixel data bit $DB2_{11}$–$DB2_{nm}$, and reads these drive pixel data bits on a display line basis in accordance with the read address supplied from the drive control circuit 2, and supplies the drive pixel data bits to an address driver 6. Next, the memory 4 regards the third bit of each pixel data $PD_{11}$–$PD_{nm}$ as a drive pixel data bit $DB3_{11}$–$DB3_{nm}$, and reads these drive pixel data bits on a display line basis in accordance with the read address supplied from the drive control circuit 2, and supplies the drive pixel data bits to an address driver 6. Then, the memory 4 regards the fourth bit of each pixel data $PD_{11}$–$PD_{nm}$ as a drive pixel data bit $DB4_{11}$–$DB4_{nm}$, and reads these drive pixel data bits on a display line basis in accordance with the read address supplied from the drive control circuit 2, and supplies the drive pixel data bits to an address driver 6.

It should be noted that during the foregoing operation, the memory 4 does not read a drive pixel data bit DB which belongs to a display line, the read address of which is not specified by the drive control circuit 2.

The drive control circuit 2 employs an appropriate light emission driving format in accordance with the positions and number of black display lines on one screen indicated by the flag registers $RF_1$–$FR_n$, and generates a variety of timing signals for driving the PDP 10 to display in gradation representation in conformity to the employed format. Then, the drive control circuit 2 supplies a variety of timing signals to each of the address driver 6, a first sustain driver 7 and a second sustain driver 8. Each of the address driver 6, first sustain driver 7 and second sustain driver 8 applies a variety of driving pulses to the column electrodes D and the row electrodes X, Y in response to the variety of timing signals supplied from the drive control circuit 2.

Figure 7:
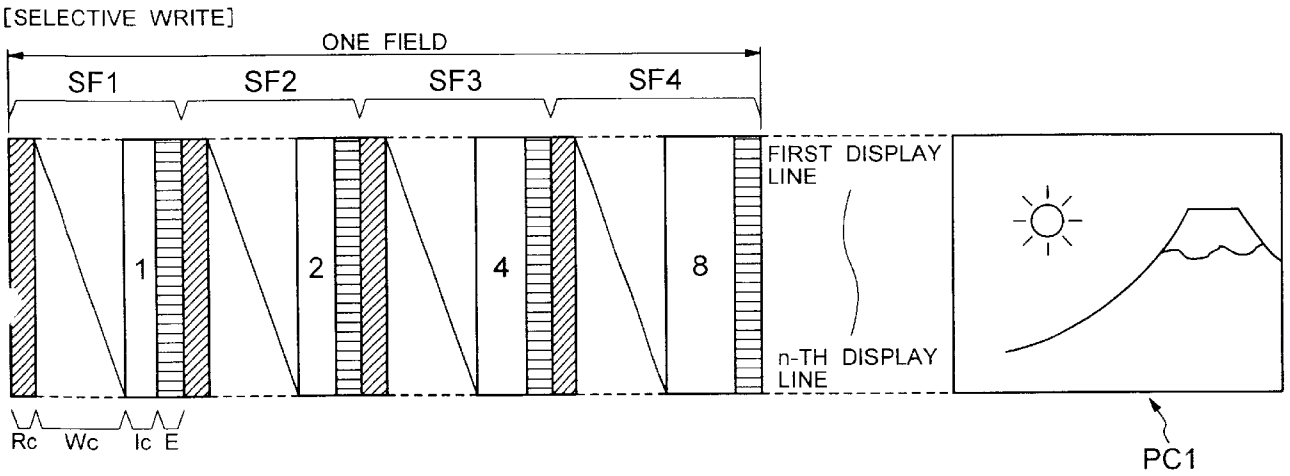
FIGS. 7 and 8 are diagrams illustrating a first light emission driving format and a second light emission driving format, respectively, based on the driving method according to the present invention.

FIG. 7 is a diagram illustrating a first light emission driving format employed by the drive control circuit 2 when a video signal corresponding to an image free of black display lines is supplied, for example, as represented by an image PC1.

In the first light emission driving format as illustrated, one field display period is divided into four subfields comprised of SF1–SF4. Then, in each of the subfields, a simultaneous reset process Rc, a pixel data writing process Wc, a light emission sustaining process Ic, and an erasure process E are performed, respectively.

Figure 9:
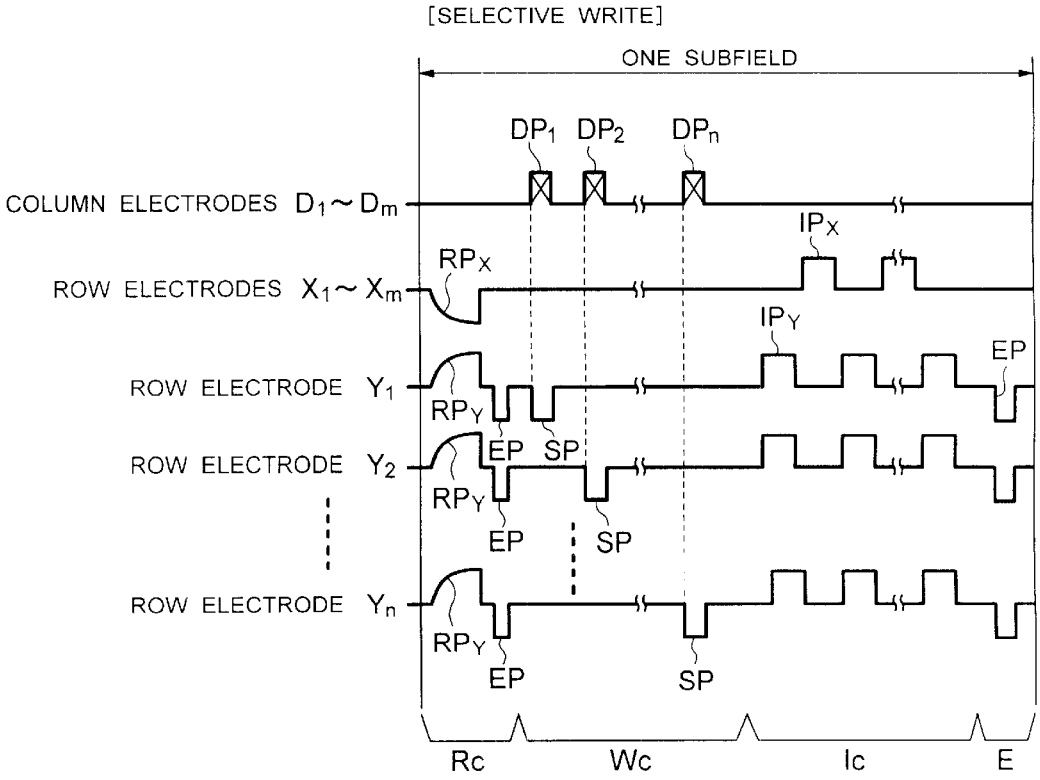
FIG. 9 is a waveform diagram showing application timings at which a variety of driving pulses are applied to the PDP 10 in accordance with the first light emission driving format.

FIG. 9 is a waveform chart showing application timings at which each of the address driver 6, first sustain driver 7 and second sustain driver 8 applies a variety of driving pulses to the column electrodes and row electrode pairs of the PDP 10 in accordance with the first light emission driving format illustrated in FIG. 7.

It should be noted that FIG. 9 only shows application timings of driving pulses within one subfield extracted from the first light emission driving format.

As shown in FIG. 9, in the simultaneous reset process Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes X, Y of the PDP 10, respectively. This causes all the discharge cells in the PDP 10 to be reset or discharged to forcedly form a uniform wall charge in each of the discharge cells. Immediately after that, the second sustain driver 8 simultaneously applies the row electrodes $X_1$–$X_n$ of the PDP 10 with the erase pulse EP having a shorter pulse width and negative polarity to erase the wall charges formed in all the discharge cells. Such an operation initializes all the discharge cells in the PDP 10 to a "non-light emitting cell" state.

In the pixel data writing process Wc, the address driver 6 generates a pixel data pulse having a voltage corresponding to a logical level of the drive pixel data bit DB supplied from the memory 4. In this event, when the plasma display device is supplied with a video signal corresponding to an image which does not include any black display line, as represented by the image PC1, the drive pixel data bits DB belonging to each of the first to n-th display lines are all read from the memory 4. Then, the address driver 6 groups the pixel data pulses every display line into pixel data pulse groups $DP_1$–$DP_n$, and sequentially applies the column electrodes $D_1$–$D_m$ with pixel data pulse groups $DP_1$–$DP_n$ from those belonging to the first display line to those belonging to the n-th display line. Assume herein that the address driver 6 generates a pixel data pulse at a high voltage when the drive pixel data bit DB is at logical level "1" and generates the pixel data pulse at a low voltage (zero volt) when the drive pixel data bit DB is at logical level "0."

Further, in the pixel data writing process Wc, the drive control circuit 2 supplies the second sustain driver 8 with a timing signal for applying the scanning pulse SP only to those display lines that correspond to flag registers RF at logical level "0. " In this event, since no black display line exists within one screen in the image PC1, the contents stored in the flag registers $FR_1$–$FR_n$ are all logical level "0." Thus, the second sustain driver 8 sequentially applies the scanning pulse SP of negative polarity to the row electrodes $Y_1$–$Y_n$ at the same timing at which each pixel data pulse group DP is applied, as shown in FIG. 9.

In the pixel data writing process Wc, the discharge (selective writing discharge) occurs only in discharge cells at intersections of "rows" applied with the scanning pulse SP with "columns" applied with the pixel data pulse at the high voltage, so that wall charges are formed selectively in these discharge cells. This selective writing discharge as described causes the discharge cells initialized to the "non-light emitting cell" state in the simultaneous reset process Rc to transition to the "light emitting cells." On the other hand, the selective writing discharge as described above does not occur in discharge cells which have been applied with the pixel data pulse at the low voltage, so that these discharge cells are maintained in the state initialized in the simultaneous reset process Rc, i.e., the "non-light emitting cell" state.

In other words, the pixel data writing process Wc sets each of the discharge cells in the PDP 10 into the "light emitting cell" or the "non-light emitting cell" state in accordance with the pixel data.

In the next light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$ as illustrated in FIG. 9. In this event, the number of times the sustain pulses IP should be applied in the light emission sustain process Ic in each subfield SF1–SF4 illustrated in FIG. 7 are as follows:

SF1: 1

SF2: 2

SF3: 4

SF4: 8

In this way, the discharge cells in which the wall charges remain, i.e., the "light emitting cells" discharge each time the sustain pulses $IP_X$, $IP_Y$ are applied thereto to sustain the light emitting state associated with the sustain discharges for the number of times (period) the sustain pulses are applied.

Figure 8:
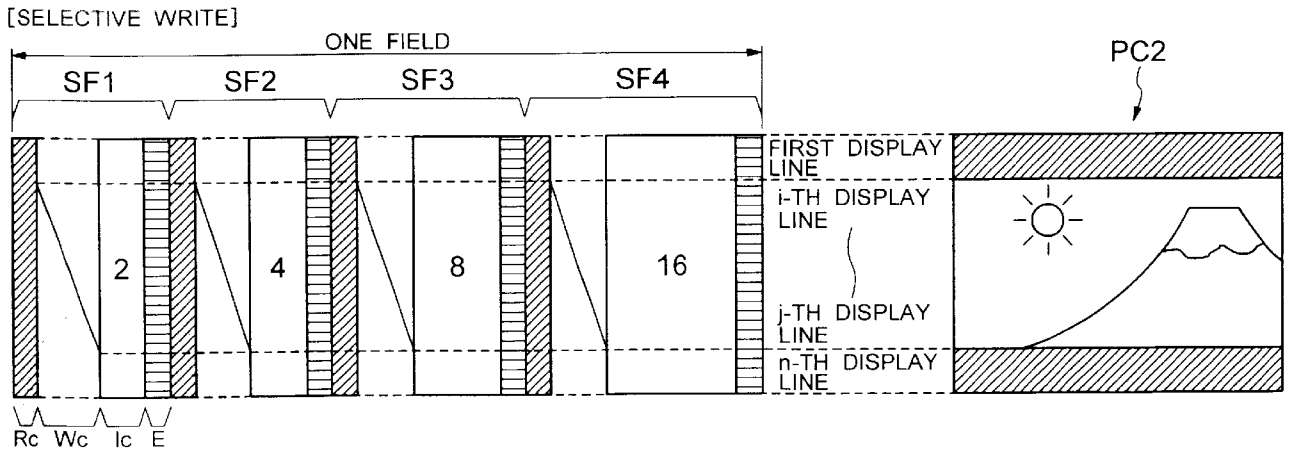

Then, in the erasure process E at the end of each subfield, the second sustain driver 8 applies the row electrodes $Y_1$–$Y_n$ with the erasure pulse EP as illustrated in FIG. 8 to simultaneously discharge all the discharge cells for erasure. This results in complete extinction of wall charges which have remained in the respective discharge cells.

A sequence of operations involved in the simultaneous reset process Rc, pixel data writing process Wc, light emission sustain process Ic and erasure process E are performed similarly for the other subfields. As described above, when the plasma display device is supplied with a video signal corresponding to an image which does not include any black display line, the PDP 10 is set to a gradation driving mode (hereinafter referred to as the "driving mode A") as illustrated in FIGS. 7 and 9. According to the driving mode A, an intermediate luminance display at 16 gradation levels is performed for a luminance range from "0" to "15" based on 16 light emission patterns in accordance with the respective pixel data PD as shown in FIG. 10.

On the other hand, when the plasma display device is supplied with a video signal corresponding to an image which includes black display lines, the plasma display device of FIG. 5 performs gradation driving based on a driving mode B which employs the light emission driving format as illustrated in FIG. 8. It should be noted that an image PC2 which includes black display lines illustrated in FIG. 8 is, for example, an image of a CinemaScope or vista size in which each of the first to (i−1)th display lines and j-th to n-th display line is a black display line, as indicated by hatching in the figure.

As the plasma display device is supplied with a video signal corresponding to the image PC2, logical level "1" is written into each of flag registers $FR_1$–$FR_{(i-1)}$ and $FR_{(j+1)}$–$FR_n$ within the flag registers $FR_1$–$FR_n$, while the contents stored in the remaining flag registers are logical level "0."

The drive control circuit 2 employs the second light emission driving format illustrated in FIG. 8 based on the contents stored in these flag registers $FR_1$–$FR_n$. Then, the drive control circuit 2 supplies each of the address driver 6, first sustain driver 7 and second sustain driver 8 with a variety of timing signals for performing the gradation driving in accordance with the second light emission driving format. The second light emission driving format is identical to the first light emission driving format illustrated in FIG. 7 in that the simultaneous reset process Rc, pixel data writing process Wc, light emission sustain process Ic and erasure process E are performed in each of four subfields SF1–SF4. However, the second light emission driving format differs from the first light emission driving format in the operations performed in each of the pixel data writing process Wc and the light emission sustain process Ic.

Figure 11:
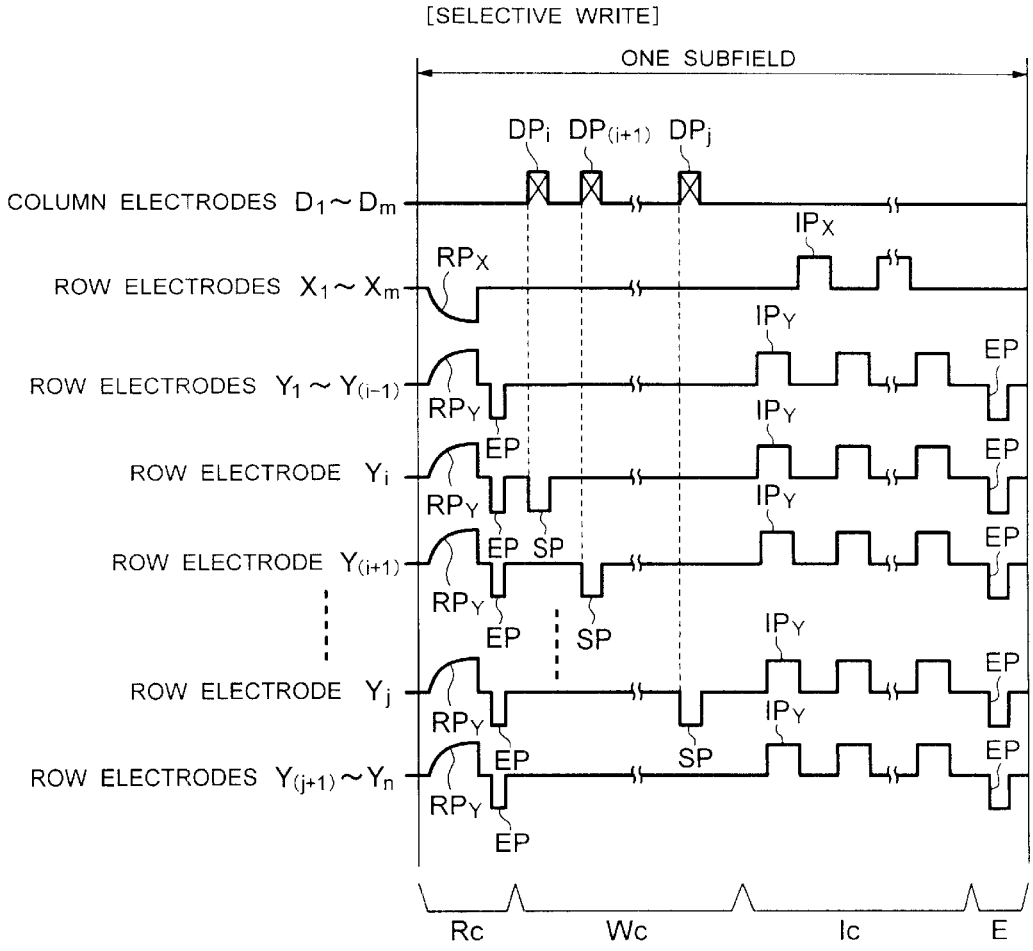
FIG. 11 is a waveform chart showing application timings at which a variety of driving pulses are applied to the PDP 10 in accordance with the second light emission driving format.

FIG. 11 shows application timings at which each of the address driver 6, first sustain driver 7 and second sustain driver 8 applies a variety of driving pulses to the column electrodes and the row electrode pairs of the PDP 10 in accordance with the second light emission driving format illustrated in FIG. 8.

It should be noted that FIG. 11 only shows application timings of driving pulses within one subfield extracted from the second light emission driving format.

As shown in FIG. 11, in the simultaneous reset process Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes X, Y of the PDP 10, respectively. This causes all the discharge cells in the PDP 10 to be reset or discharged to forcedly form a wall charge in each of the discharge cells. Immediately after that, the second sustain driver 8 simultaneously applies the row electrodes $X_1$–$X_n$ of the PDP 10 with the erase pulse EP having a shorter pulse width and negative polarity to erase the wall charges formed in all the discharge cells. Such an operation initializes all the discharge cells in the PDP 10 to "non-light emitting cell" state.

In the pixel data writing process Wc, the address driver 6 generates a pixel data pulse having a voltage corresponding to a logical level of the drive pixel data bit DB supplied from the memory 4. In this event, when the plasma display device is supplied with a video signal corresponding to an image which includes black display lines, as represented by the image PC2, the drive pixel data bits DB belonging to each of the first to J-th display lines are only read from the memory 4. In other words, the drive pixel data bits DB belonging to each of the remaining first to (i−1)th display lines and (j+1)th to n-th display lines are not read from the memory 4. Therefore, the address driver 6 applies the column electrodes $D_1$–$D_m$ with a pixel data pulse group $DP_i$ belonging to an i-th display line to a pixel data pulse group $DP_j$ belonging to a j-th display line sequentially every display line, as illustrated in FIG. 11. The address driver 6 generates a pixel data pulse at a high voltage when the drive pixel data bit DB is at logical level "11" and generates the pixel data pulse at a low voltage (zero volt) when the drive pixel data bit DB is at logical level "0."

Further, in the pixel data writing process Wc, the drive control circuit 2 supplies the second sustain driver 8 with a timing signal for applying the scanning pulse SP only to those display lines that correspond to flag registers RF at logical level "0." In this event, each of the first to (i−1)th display lines and the (j+1)th to n-th display lines in one screen is a black display line, as indicated by the hatchings in the image PC2. Thus, in this event, logical level "1" is stored in the flag registers $FR_1$–$FR(i-_1)$ and $FR_{(j+1)}$–$FR_n$ within the flag registers $FR_1$–$RF_n$, and logical level "0" is stored in the remaining flag registers $FR_i$–$FR_j$. Thus, the second sustain driver 8 sequentially applies the scanning pulse SP of negative polarity only to the low electrodes $Y_1$–$Y_j$ within the row electrodes $Y_1$–$Y_n$, as shown in FIG. 11.

In the pixel data writing process Wc, the discharge (selective writing discharge) occurs only in discharge cells at intersections of "rows" applied with the scanning pulse SP with "columns" applied with the pixel data pulse at the high voltage, so that wall charges are formed selectively in these discharge cells. This selective writing discharge as described causes the discharge cells initialized to the "non-light emitting cell" state in the simultaneous reset process Rc to transition to the "light emitting cells." On the other hand, the selective writing discharge as described above does not occur in discharge cells which have been applied with the pixel data pulse at the low voltage, so that these discharge cells are maintained in the state initialized in the simultaneous reset process Rc, i.e., the "non-light emitting cell" state.

In other words, the pixel data writing process Wc sets each of the discharge cells in the PDP 10 into the "light emitting cell" or the "non-light emitting cell" state in accordance with pixel data as shown in FIG. 11.

In the next light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$. In this event, the number of times the sustain pulses IP should be applied in the light emission sustain process Ic in each subfield SF1–SF4 illustrated in FIG. 8 are as follows:

SF1: 2
SF2: 4
SF3: 8
SF4: 16

In this way, the discharge cells in which the wall charges remain, i.e., the "light emitting cells" discharge each time the sustain pulses $IP_X$, $IP_Y$ are applied thereto to sustain the light emitting state associated with the sustain discharges for the number of times (period) the sustain pulses are applied.

Then, in the erasure process E at the end of each subfield, the second sustain driver 8 applies the row electrodes $Y_1$–$Y_n$ with the erasure pulse EP as illustrated in FIG. 11 to simultaneously discharge all the discharge cells for erasure. This results in complete extinction of wall charges which have remained in the respective discharge cells.

As described above, when the plasma display device is supplied with a video signal corresponding to an image which includes black display lines as represented by the image PC2, the PDP 10 is set to the driving mode B as illustrated in FIGS. 8 and 11. The driving mode B thus performed provides an intermediate luminance display at 16 gradation levels for a luminance range from "0" to "30," higher than the driving mode A, as shown in FIG. 10.

Specifically, when a black display line exists in one screen, the application of the scanning pulse SP and a pixel data pulse group DP for the black display line are stopped to reduce a time required for performing each pixel data writing process Wc. Stated another way, since discharge cells corresponding to the black display line, which has a luminance level "0," may be fixed in the non-light emitting state without even taking into account their pixel data, writing of pixel data into the black display line is stopped. Then, a light emitting period (number of times) allocated to the light emission sustain process Ic within each subfield is increased by the reduction in time for the pixel data writing process Wc as mentioned above, thereby increasing the display luminance of the overall image.

The foregoing embodiment has been described for the so-called selective writing address method which is employed as a method of writing pixel data, wherein each of discharge cells is selectively discharged (selective writing discharge) in accordance with pixel data to form wall charges within the discharge cells to write pixel data.

The present invention, however, is similarly applicable to the so-called selective erasure address method which may be employed as a method of writing pixel data, wherein a wall discharge formed in each of discharge cells is selectively erased in accordance with pixel data.

Figure 12:
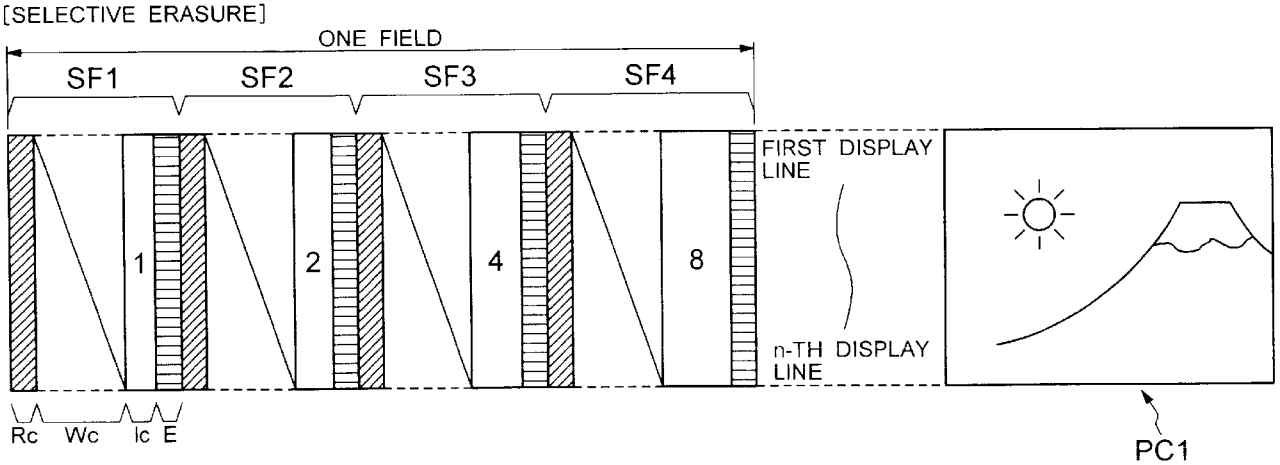
FIGS. 12 and 13 are diagrams illustrating a first light emission driving format and a second light emission driving format, respectively, when a selective erasure address method is employed.

FIG. 12 is a diagram illustrating a first light emission driving format employed by the drive control circuit 2 when the selective erasure address method is employed as a method of writing pixel data. Specifically, FIG. 12 illustrates a light emission driving format which is employed when the plasma display device is supplied with a video signal corresponding to an image which does not include any black lines, for example, as represented by an image PC1. In this event, the illustrated light emission driving format is identical to those illustrated in FIGS. 7 and 8 in that the simultaneous reset process Rc, pixel data writing process Wc, light emission sustain process Ic and erasure process E are performed in each of four subfields SF1–SF4.

Figure 14:
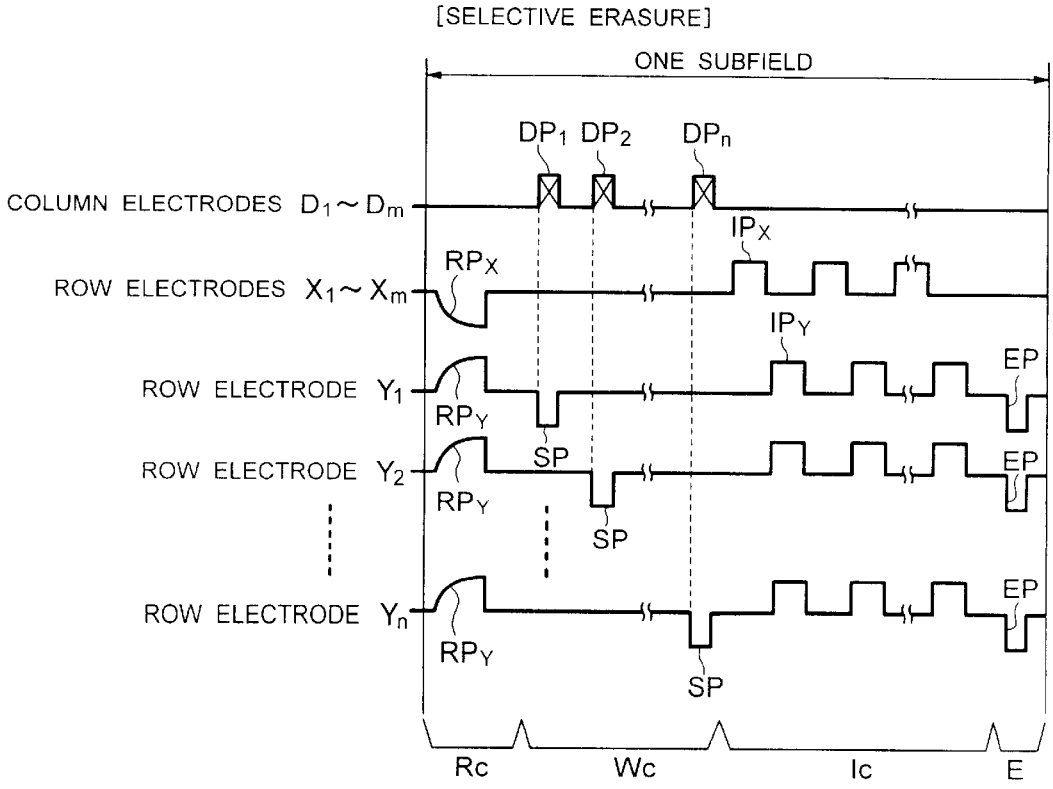
FIG. 14 is a waveform diagram showing application timings at which a variety of driving pulses are applied to the PDP 10 in accordance with the first light emission driving format illustrated in FIG. 12.

FIG. 14 is a waveform chart showing application timings at which each of the first sustain driver 7 and second sustain driver 8 applies a variety of driving pulses to the column electrodes and the row electrode pairs in the PDP 10 in accordance with the first light emission driving format illustrated in FIG. 12. It should be noted that FIG. 14 only shows application timings of driving pulses within one subfield extracted from the first light emission driving format illustrated in FIG. 12.

In FIG. 14, in the simultaneous reset process Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes X, Y of the PDP 10, respectively. This causes all the discharge cells in the PDP 10 to be reset or discharged to forcedly form a wall charge in each of the discharge cells. Such an operation initializes all the discharge cells in the PDP 10 to a "light emitting cell" state.

In the pixel data writing process Wc, the address driver 6 generates a pixel data pulse having a voltage corresponding to a logical level of the drive pixel data bit DB supplied from the memory 4. In this event, when the plasma display device is supplied with a video signal corresponding to an image which does not include any black display line, as represented by the image PC1, the drive pixel data bits DB belonging to each of the first to n-th display lines are all read from the memory 4. Then, the address driver 6 groups the pixel data pulses every display line into pixel data pulse groups $DP_1$–$DP_n$, and sequentially applies the column electrodes $D_1$–$D_m$ with pixel data pulse groups $DP_1$–$DP_n$ from those belonging to the first display line to those belonging to the n-th display line. Assume herein that the address driver 6 generates a pixel data pulse at a high voltage when the drive pixel data bit DB is at logical level "1" and generates the pixel data pulse at a low voltage (zero volt) when the drive pixel data bit DB is at logical level "0."

Further, in the pixel data writing process Wc, the drive control circuit 2 supplies the second sustain driver 8 with a timing signal for applying the scanning pulse SP only to those display lines that correspond to flag registers RF at logical level "0." In this event, since no black display line exists within one image in the image PC1, the contents stored in the flag registers $FR_1$–$FR_n$ are all logical level "0." Thus, the second sustain driver 8 sequentially applies the scanning pulse SP of negative polarity to the row electrodes $Y_1$–$Y_n$ at the same timing at which each pixel data pulse group DP is applied, as shown in FIG. 14.

In the pixel data writing process Wc, the discharge (selective writing discharge) occurs only in discharge cells at intersections of "rows" applied with the scanning pulse SP with "columns" applied with the pixel data pulse at the high voltage to extinguish the wall charges formed in the discharge cells. This selective writing discharge as described causes the discharge cells initialized to the "light emitting cell" state in the simultaneous reset process Rc to transition to the "non-light emitting cells." On the other hand, the selective writing discharge as described above does not occur in discharge cells which have been applied with the pixel data pulse at the low voltage, so that these discharge cells are maintained in the initialized state in the simultaneous reset process Rc, i.e., the "light emitting cell" state.

In the next light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as illustrated in FIG. 14. In this event, as shown in FIG. 12, the number of times the sustain pulses IP should be applied in the light emission sustain process Ic in each subfield SF1–SF4 are as follows:

SF1: 1
SF2: 2
SF3: 4
SF4: 8

In this way, the discharge cells in which the wall charges remain, i.e., the "light emitting cells" discharge each time the sustain pulses $IP_X$, $IP_Y$ are applied thereto to sustain the light emitting state associated with the sustain discharges for the number of times (period) the sustain pulses are applied.

Then, in the erasure process E at the end of each subfield, the second sustain driver 8 applies the row electrodes $Y_1$–$Y_n$ with the erasure pulse EP as illustrated in FIG. 8 to simultaneously discharge all the discharge cells for erasure. This results in complete extinction of wall charges which have remained in the respective discharge cells.

A sequence of operations involved in the simultaneous reset process Rc, pixel data writing process Wc, light emission sustain process Ic and erasure process E are performed similarly for the other subfields.

As described above, when the plasma display device is supplied with a video signal corresponding to an image which does not include any black display line as represented by the image PC1, the PDP 10 is set to a gradation driving mode (hereinafter referred to as the "driving mode A") as illustrated in FIGS. 12 and 14. Consequently, an intermediate luminance display at 16 gradation levels is performed for a luminance range from "0" to "15" as is the case where the aforementioned selective writing address method is employed.

On the other hand, when the plasma display device is supplied with a video signal corresponding to an image of, for example, a vista size or a CinemaScope size, which includes black display lines, as represented by an image PC2, a gradation driving mode is performed as described below.

In this event, as the plasma display device is supplied with a video signal corresponding to the image PC2, logical level "1" is written into each of flag registers $FR_1$–$FR_{(i-1)}$ and $FR_{(j+1)}$–$FR_n$ within the flag registers $FR_1$–$FR_n$, while the contents stored in the remaining flag registers are logical level "0."

Figure 13:
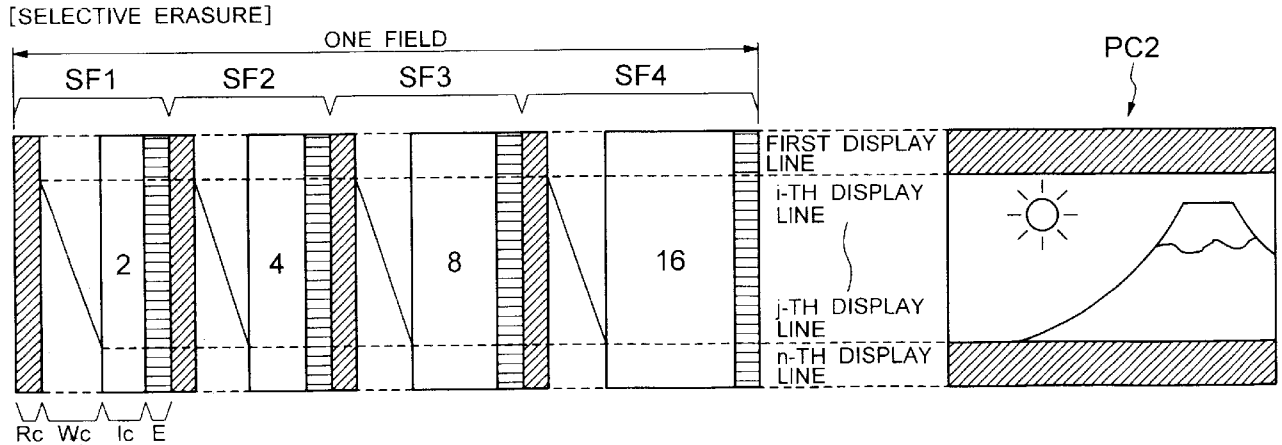

The drive control circuit 2 employs the second light emission driving format illustrated in FIG. 13 based on the contents stored in these flag registers $FR_1$–$FR_n$. Then, the drive control circuit 2 supplies each of the address driver 6, first sustain driver 7 and second sustain driver 8 with a variety of timing signals for performing the gradation driving in accordance with the second light emission driving format. The second light emission driving format is identical to the first light emission driving format illustrated in FIG. 12 in that the simultaneous reset process Rc, pixel data writing process Wc, light emission sustain process Ic and erasure process E are performed in each of the four subfields SF1–SF4. However, the second light emission driving format differs from the first light emission driving format in the operations performed in each of the pixel data writing process Wc and the light emission sustain process Ic.

Figure 15:
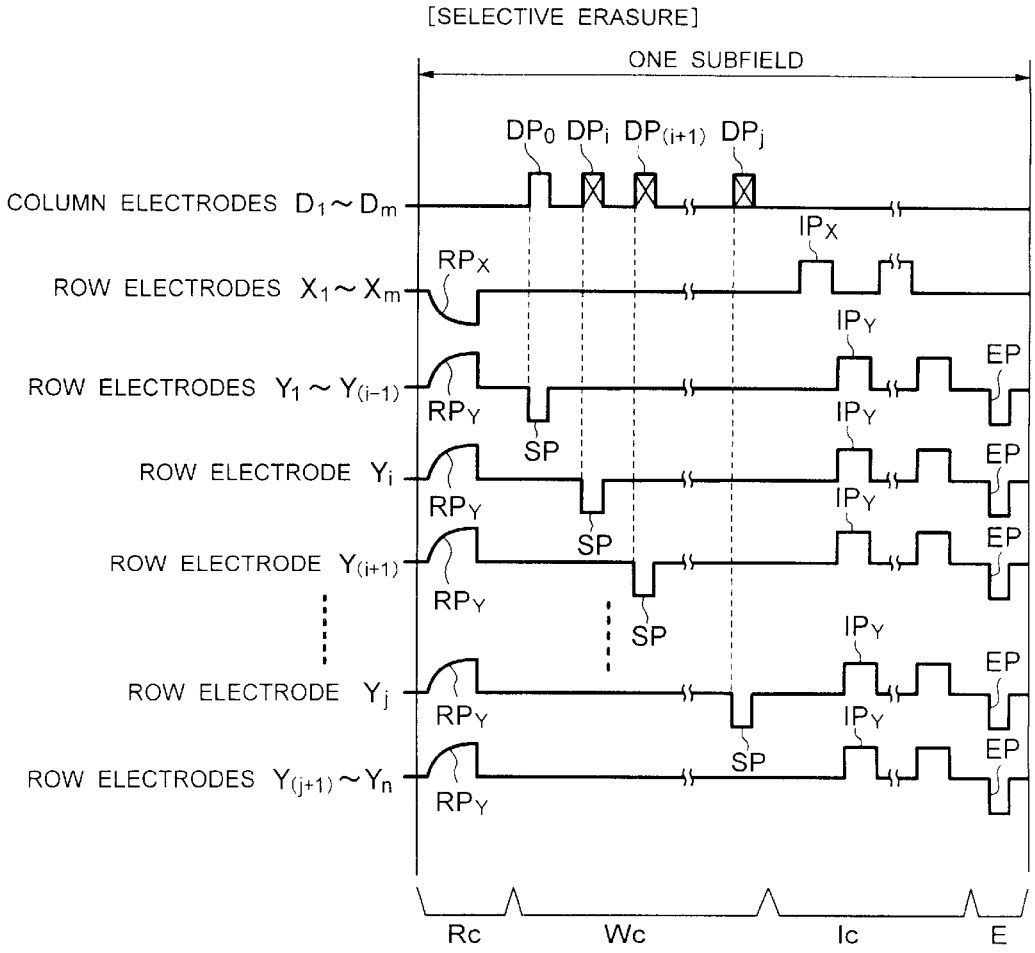
FIG. 15 is a waveform diagram showing application timings at which a variety of driving pulses are applied to the PDP 10 in accordance with the second light emission driving format illustrated in FIG. 13.

FIG. 15 shows application timings at which each of the address driver 6, first sustain driver 7 and second sustain driver 8 applies a variety of driving pulses to the column electrodes and the row electrode pairs of the PDP 10 in accordance with the second light emission driving format illustrated in FIG. 13. It should be noted that FIG. 15 only shows application timings of driving pulses within one subfield extracted from the second light emission driving format illustrated in FIG. 13.

In FIG. 15, in the simultaneous reset process Rc, the first sustain driver 7 generates the reset pulse $RP_X$ of negative polarity, while the second sustain driver 8 generates the reset pulse $RP_Y$ of positive polarity. These reset pulses are simultaneously applied to the row electrodes X, Y of the PDP 10, respectively. This causes all the discharge cells in the PDP 10 to be reset or discharged to forcedly form a wall charge in each of the discharge cells. Such an operation initializes all the discharge cells in the PDP 10 to a "light emitting cell" state.

In the pixel data writing process Wc, the address driver 6 applies the column electrodes $D_1$–$D_m$ with a pixel data pulse group $DP_0$ comprised of m pixel data pulses each having a high voltage. In this event, at the same timing at which the pixel data pulse group $DP_0$ is applied, the second sustain driver 8 simultaneously applies the scanning pulse SP of negative polarity to each of the row electrodes $Y_1$–$Y_{i-1}$ and $Y_{j+1}$–$Y_n$, as shown in FIG. 15. In response to the simultaneous application of these pixel data pulse group $DP_0$ and scanning pulse SP, an erasure discharge occurs in all discharge cells belonging to each of the first display line to the (i−1)th display line and the (j+1)th display line to the n-th display line of the PDP 10. This results in extinction of the wall charges formed in all the discharge cells belonging to each of the first display line to the (i−1)th display line and the (j+1)th display line to the n-th display line, causing each of these discharge cells to transition to a "non-light emitting cell." After the application of the pixel data pulse group $DP_0$, the address driver 6 generates a pixel data pulse having a voltage corresponding to a logical level of the drive pixel data bit DB supplied from the memory 4. In this event, when the plasma display device is supplied with a video signal corresponding to an image which includes black display lines, as represented by the image PC2, the drive pixel data bits DB belonging to each of the first to j-th display lines are only read from the memory 4. Therefore, the address driver 6 sequentially applies the column electrodes $D_1$–$D_m$ with a pixel data pulse group $DP_i$ belonging to an i-th display line to a pixel data pulse group $PD_j$ belonging to a j-th display line every display line, as illustrated in FIG. 15. The address driver 6 generates a pixel data pulse at a high voltage when the drive pixel data bit DB is at logical level "1" and generates the pixel data pulse at a low voltage (zero volt) when the drive pixel data bit DB is at logical level "0." Then, at the timing at which each of the pixel data pulse group $DP_i$ to the pixel data pulse group $PD_j$ is applied, the second sustain driver 8 sequentially applies the scanning pulse SP of negative polarity only to the row electrodes $Y_i$–$Y_j$ within the row electrodes $Y_1$–$Y_n$. Consequently, the discharge (selective writing discharge) occurs only in discharge cells at intersections of "rows" applied with the scanning pulse SP with "columns" applied with the pixel data pulse at the high voltage to extinguish the wall charges formed in the discharge cells. This selective writing discharge causes the discharge cells in which the selective erasure discharge occurred to transition to the "non-light emitting cells," while the discharge cells in which the selective erasure discharge did not occur maintain the "light-emitting cell" state.

In the pixel data writing process Wc illustrated in FIGS. 13 and 15, discharge cells belonging to each of the i-th display line to the j-th display line of the PDP 10 are set into the "light emitting cell" or "non-light emitting cell" state in accordance with pixel data. On the other hand, all discharge cells belonging to each of the remaining display lines, i.e., the first display line to the (i−1)th display line and the (j+1)th display line to the n-th display line are forcedly set to the "non-light emitting cells."

In the next light emission sustain process Ic, the first sustain driver 7 and the second sustain driver 8 alternately apply the sustain pulses $IP_X$, $IP_Y$ of positive polarity to the row electrodes $X_1$–$X_n$ and $Y_1$–$Y_n$, as shown in FIG. 15. In this event, the number of times the sustain pulses IP should be applied in the light emission sustain process Ic in each subfield SF1–SF4 as illustrated in FIG. 13 are as follows:

SF1: 2
SF2: 4
SF3: 8
SF4: 16

In this way, only the discharge cells in which the wall charges remain, i.e., the "light emitting cells" discharge each time the sustain pulses $IP_X$, $IP_Y$ are applied thereto to sustain the light emitting state associated with the sustain discharges for the number of times (period) the sustain pulses are applied.

Then, in the erasure process E at the end of each subfield, the second sustain driver 8 applies the row electrodes $Y_1$–$Y_n$ with the erasure pulse EP to simultaneously discharge all the discharge cells for erasure. This results in complete extinction of wall charges which have remained in the respective discharge cells.

As described above, when the plasma display device is supplied with a video signal corresponding to an image which includes black display lines as represented by the image PC2, the PDP 10 performs the gradation driving (driving mode B) as illustrated in FIGS. 13 and 15. The driving mode B thus performed provides an intermediate luminance display at 16 gradation levels for a luminance range from "0" to "30" as is the case where the aforementioned selective writing address method is employed. In this event, discharge cells belonging to the black display lines are simultaneously applied with the scanning pulse SP and the pixel data pulse group $DP_0$ at a high voltage, as shown in FIG. 15, to produce an erasure discharge, forcing the discharge cells to transition to the "non-light emitting cell" state. Thus, as is the case where the selective writing address method as described above is employed, the operation for writing pixel data into the black display lines is omitted, thereby reducing a time required for performing each pixel data writing process Wc.

In essence, in the present invention, pixel data is sequentially written into each of pixel cells on every display line belonging to a region other than a black display region comprised of the black display lines. On the other hand, the writing of pixel data is stopped for each of pixel cells on the display lines belonging to the black display region, or these cells are simultaneously set into the "non-light emitting cell" state. Since this results in a reduction in time spent for each pixel data writing process in one field, a light emitting period (number of times) allocated to the light emission sustain process Ic within each subfield is increased by the reduction in time for the pixel data writing process Wc as mentioned above, thereby making it possible to increase the luminance of the overall displayed image.

While the foregoing embodiment has been described for a video signal, as an input to the plasma display device, which carries an image including black display lines in upper and lower portions of a screen, as represented by the image PC2, similar effects can be produced as well for a video signal which includes black display lines in other portions.

It should be noted that the plasma display panel driving method according to the present invention can also be applied to a plasma display device which has another configuration than the plasma display device as illustrated in FIG. 5.

Figure 16:
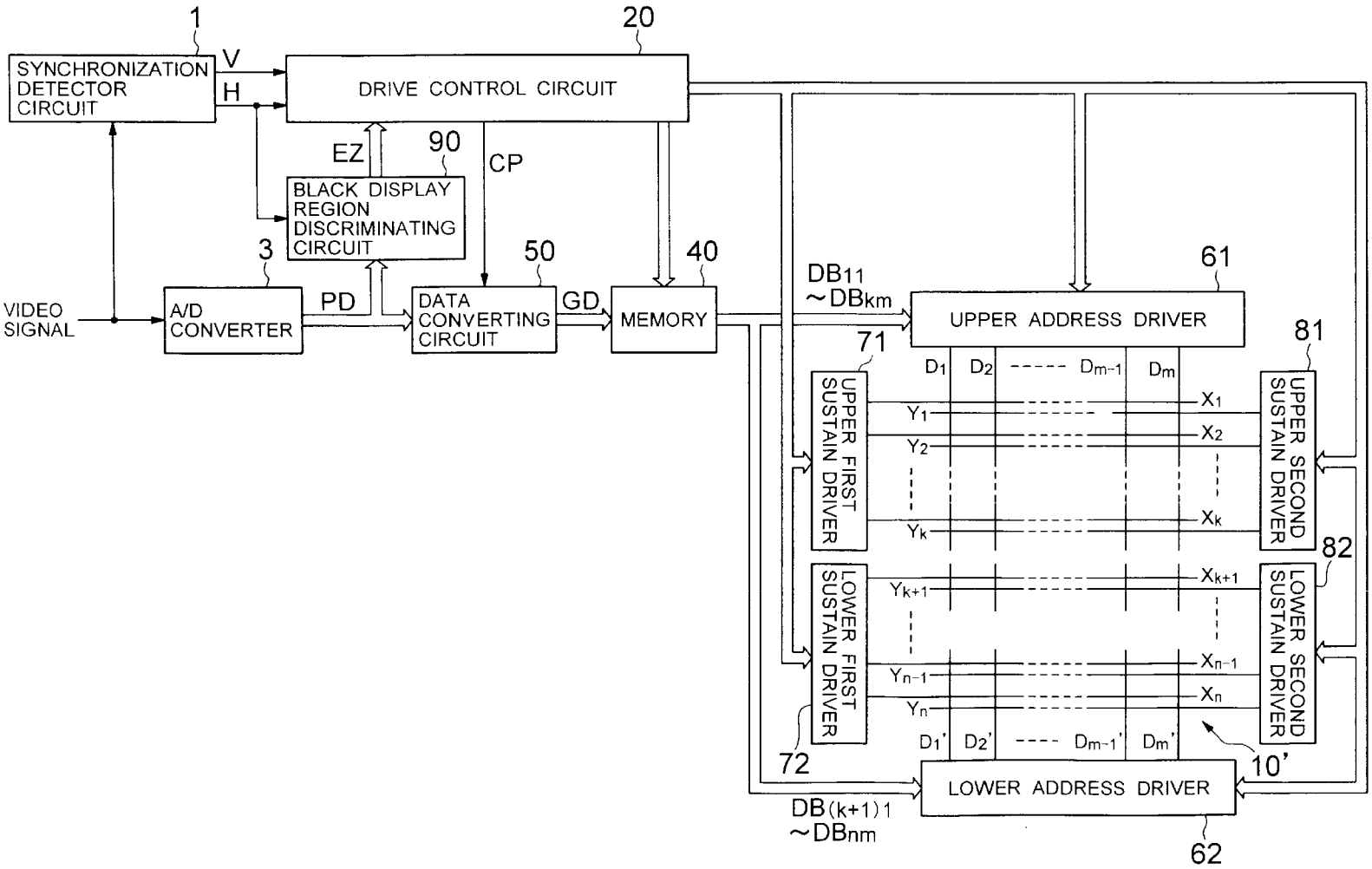
FIG. 16 is a block diagram illustrating another configuration of a plasma display device for driving a plasma display panel based on the driving method according to the present invention.

FIG. 16 is a block diagram illustrating another configuration of a plasma display device for driving a PDP to display in a gradation representation in accordance with the plasma display panel driving method according to the present invention.

A PDP 10' comprises m column electrodes $D_1$–$D_m$ serving as upper address electrodes on the screen, m column electrodes $D_1$–$D_m'$ serving as lower address electrodes on the screen, and n row electrodes $X_1$–$X_n$ and n row electrodes $Y_1$–$Y_n$ which are arranged to intersect these column electrodes. A Pair of these row electrodes X, Y form a row electrode corresponding to one display line in the PDP 10. The column electrodes D and the row electrodes X, Y are covered with a dielectric layer defining a discharge space, and a discharge cell corresponding to one pixel is formed at an intersection of each row electrode pair with each column electrode.

A synchronization detector circuit 1 generates a vertical synchronization detecting signal V when it detects a vertical synchronization signal from an input video signal, and supplies the signal V to a drive control circuit 2. Further, the synchronization detector circuit 1 generates a horizontal synchronization detecting signal H when it detects a horizontal synchronization signal from the input video signal, and supplies the signal H to each of the drive control circuit 2 and a black display region discriminating circuit 90.

An A/D converter 3 samples the input video signal for conversion to a 4-bit pixel data PD, for example, representative of a luminance level for each pixel, and supplied the pixel data PD to each of the black display region discriminating circuit 90 and a data converting circuit 50.

The black display region discriminating circuit 90 accumulates the pixel data PD, in each of display line groups comprised of a plurality of display lines adjacent to each other, corresponding to the display line group. Then, the black display region discriminating circuit 90 determines that the display line group belongs to a black display region having a luminance level "0" when the result of accumulation for the display line is "0." Also, the black display region discriminating circuit 90 determines a display line group belongs to a black display region including a caption when the result of accumulating pixel data PD corresponding to the display line group is larger than "0" and smaller than a predetermined value. Further, the black display region discriminating circuit 90 determines that a display line group belongs to a normal image display region when the result of accumulating pixel data PD corresponding to the display line group is larger than the predetermined value. Then, the black display region discriminating circuit 90 supplies a drive control circuit 20 with a black display region discriminating signal EZ which indicates the determination result corresponding to each display line group. In this event, the drive control circuit 20 detects a black display region including a caption from one screen based on the black display region discriminating signal EZ, and supplies the data converting circuit 50 with a caption region detecting signal CP at logical level "1" when detected and at logical level "0" when not detected. The data converting circuit 50 uses a conversion table in accordance with the logical level of the caption region detecting signal CP to convert 4-bit pixel data PD supplied from the A/D converter 3 to a 15-bit drive pixel data GD which is supplied to a memory 40.

Figure 17:
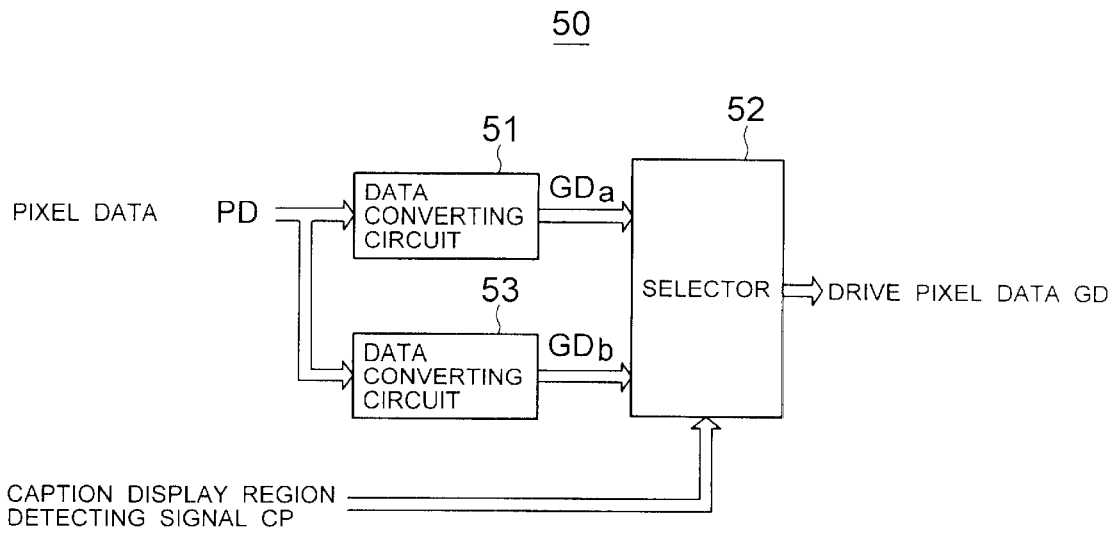
FIG. 17 is a block diagram illustrating the internal configuration of a data converting circuit 50.

FIG. 17 is a block diagram illustrating an exemplary internal configuration of the data converting circuit 50.

In FIG. 17, a data converting circuit 51 converts the 4-bit pixel data PD to 15-bit drive pixel data $GD_a$ in accordance with a conversion table as shown in FIG. 18, and supplies the 15-bit drive pixel data $GD_a$ to a selector 52. A data converting circuit 53 converts the 4-bit pixel data PD to 15-bit drive pixel data $GD_b$ in accordance with a conversion table as shown in FIG. 19, and supplies the 15-bit drive pixel data $GD_b$ to a selector 52. The selector 52 selects the drive pixel data $GD_a$ from the drive pixel data $GD_a$ and $GD_b$ when it is supplied with the caption region detecting signal CP at logical level "0" and supplies the selected drive pixel data $GD_a$ to the memory 40 as drive pixel data GD. On the other hand, the selector selects drive pixel data $GD_b$ when it is supplied with the caption region detecting signal CP at logical level "1" and supplies the selected drive pixel data $GD_b$ to the memory 40 as drive pixel data GD.

Specifically, when a black display region including a caption exists in one screen, the data converting circuit 50 converts 4-bit pixel data PD belonging to the black display region converts to 15-bit drive pixel data GD in accordance with the conversion table as shown in FIG. 19. On the other hand, when a black display region including a caption as mentioned above does not exist in one screen, the data converting circuit 50 converts 4-bit pixel data PD to 15-bit drive pixel data GD in accordance with the conversion table as shown in FIG. 18.

The drive control circuit 20 supplies the memory 40 with a write signal for writing the pixel data PD. Further, the drive control circuit 20 supplies the memory 40 with a read address and a read signal for sequentially reading pixel data written into the memory 40 from those belonging to a first display line at the top of the screen to those belonging to a k-th display line in a central region of the screen. In parallel with this, the drive control circuit 20 supplies the memory 40 with a read address and a read signal for sequentially reading pixel data written into the memory 40 from those belonging to an n-th display line at the bottom of the screen to those belonging to a (k+1)th display line in the central region of the screen.

The memory 40 sequentially stores the drive pixel data GD in response to the write signal supplied from the drive control circuit 20. Then, as the writing has been completed for one screen, i.e., from drive pixel data $GD_{11}$ corresponding to the pixel at the first row, first column to drive pixel data $GD_{nm}$ corresponding to a pixel at n-th row, m-th column, the memory 40 performs a read operation as follows.

It should be noted that in the memory 40, each of drive pixel data $GD_{11}$–$GD_{nm}$ are divided into respective bit digits as follows:

$DB1_{11}$–$DB1_{nm}$: first bits of respective $GD_{11}$–$GD_{nm}$;
$DB2_{11}$–$DB2_{nm}$: second bits of respective $GD_{11}$–$GD_{nm}$;
$DB3_{11}$–$DB3_{nm}$: third bits of respective $GD_{11}$–$GD_{nm}$;
$DB4_{11}$–$DB4_{nm}$: fourth bits of respective $GD_{11}$–$GD_{nm}$;
$DB5_{11}$–$DB5_{nm}$: fifth bits of respective $GD_{11}$–$GD_{nm}$;

$DB6_{11}$–$DB6_{nm}$: sixth bits of respective $GD_{11}$–$GD_{nm}$;

$DB7_{11}$–$DB7_{nm}$: seventh bits of respective $GD_{11-GDnm}$;

$DB8_{11}$–$DB8_{nm}$: eighth bits of respective $GD_{11}$–$GD_{nm}$;

$DB9_{11}$–$DB9_{nm}$: ninth bits of respective $GD_{11}$–$GD_{nm}$;

$DB10_{11}$–$DB10_{nm}$: tenth bits of respective $GD_{11}$–$GD_{nm}$;

$DB11_{11}$–$DB11_{nm}$: eleventh bits of respective $GD_{11}$–$GD_{nm}$;

$DB12_{11}$–$DB12_{nm}$: twelfth bits of respective $GD_{11}$–$GD_{nm}$;

$DB13_{11}$–$DB13_{nm}$: thirteenth bits of respective $GD_{11}$–$GD_{nm}$:

$DB14_{11}$–$DB14_{nm}$: fourteenth bits of respective $GD_{11}$–$GD_{nm}$;

$DB15_{11}$–$DB15_{nm}$: fifteenth bits of respective $GD_{11}$–$GD_{nm}$ and they are regarded as drive pixel data bits DB1–DB15.

The memory 40 first reads the drive pixel data bits $DB1_{11}$–$DB1_{km}$, for every display line, corresponding to each of the first display line to the k-th display line in the upper half of the screen within the drive pixel data bits $DB1_{11}$–$DB1_{nm}$ in the order of the first display line to the k-th display line, and supplies the drive pixel data bits $DB_{11}$–$DB1_{km}$ to the upper address driver 61. In parallel with this read operation, the memory 40 reads the drive pixel data bits $DB1_{(k+1)}$–$DB1_{nm}$, for every display line, corresponding to the (k+1)th display line to the n-th display line in the lower half of the screen within the drive pixel data bits $DB1_{11}$–$DB1_{nm}$ in the order of the n-th display line to the (k+11)th display line, and supplies the drive pixel data bits $DB1_{(k+1)1}$–$DB1_{nm}$ to the lower address driver 62. Next, the memory 40 reads the drive pixel data bits $DB2_{11}$–$DB2_{km}$, for every display line, corresponding to the first display line to the k-th display line in the upper half of the screen within the drive pixel data bits $DB2_{11}$–$DB2_{nm}$ in the order of the first display line to the k-th display line, and supplies the drive pixel data bits $DB2_{11}$–$DB2_{km}$ to the upper address driver 61. In parallel with this read operation, the memory 40 reads the drive pixel data bits $DB2_{(k+1)1}$–$DB2_{nm}$, for every display line, corresponding to the (k+1)th display line to the n-th display line in the lower half of the screen within the drive pixel data bits $DB2_{11}$–$DB2_{nm}$ in the order of the nth display line to the (k+1)th display line, and supplies the drive pixel data bits $DB2_{(k+1)1}$–$DB2_{nm}$ to the lower address driver 62.

Then, the memory 40 sequentially performs the read operation as described above in a similar manner for each of the drive pixel data bits DB3–DB15.

Figure 20:
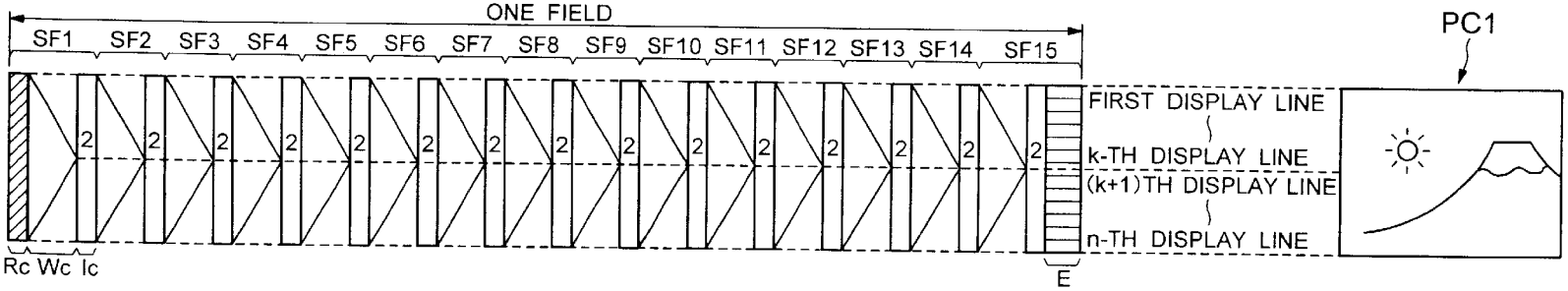
FIGS. 20 to 22 are diagrams illustrating a first light emission driving format to a third light emission driving format used in the plasma display device illustrated in FIG. 16.
Figure 21:
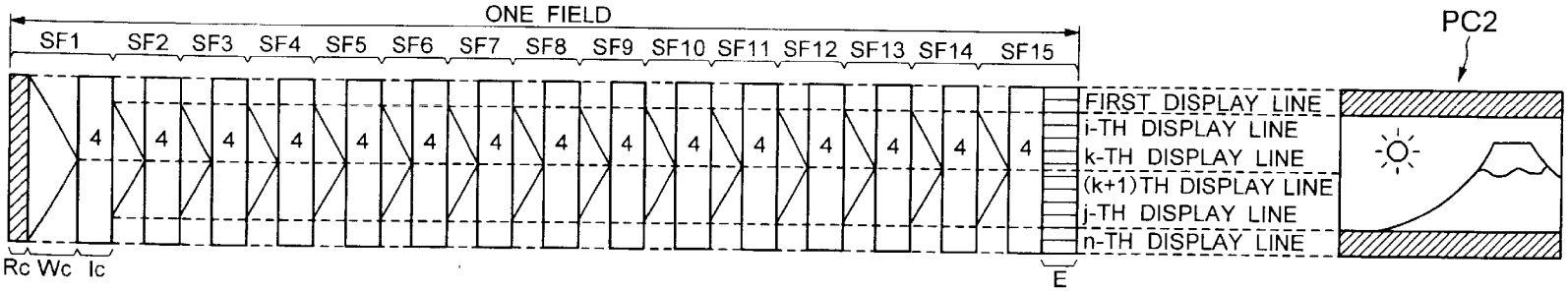
Figure 22:
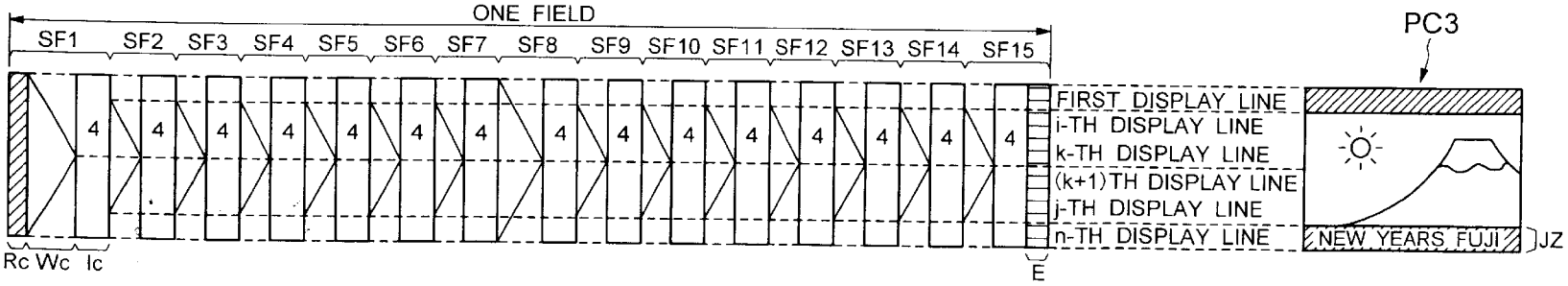

The drive control circuit 20 selects a light emission driving format in accordance with the black display region discriminating signal EZ from the light emission driving formats illustrated in FIGS. 20 to 22. Specifically, when the plasma display device is supplied with a video signal corresponding to an image which does not include any black display region within one screen as represented by the image PC1, the drive control circuit 20 selects the first light emission driving format illustrated in FIG. 20 from the formats illustrated in FIGS. 20 to 22. Alternatively, when the plasma display device is supplied with a video signal corresponding to an image which has a black display region (indicated by hatchings) within one screen as represented by the image PC2, the driver control circuit 20 selects the second light emission driving format illustrated in FIG. 21 from the formats illustrated in FIGS. 20 to 22. Further alternatively, when the plasma display device is supplied with a video signal corresponding to an image which has a black display region JZ including a caption within one screen as represented by the image PC3, the drive control circuit 20 selects the third light emission driving format illustrated in FIG. 22 from the formats illustrated in FIGS. 20 to 22.

In the light emission driving formats illustrated in FIGS. 20 to 22, one field display period is divided into 15 subfields SF1–SF15, and the pixel data writing process Wc and the light emission sustain process Ic are performed in each of the subfields. The simultaneous reset process Rc is performed only in the first subfield SF1, and the erasure process E is performed only in the last subfield SF15.

The drive control circuit 20 generates a variety of timing signals for driving the PDP 10' to display in gradation representation in accordance with the light emission driving format selected in the manner described above. Then, the drive control circuit 20 supplies each of the timing signals to each of the upper address driver 61, lower address driver 62, upper first sustain driver 71, lower first sustain driver 72, upper second sustain driver 81 and lower second sustain driver 82.

These drivers apply a variety of driving pulses to the column electrodes D and the row electrodes X, Y of the PDP 10' in response to the variety of timing signals supplied from the drive control circuit 20.

Figure 23:
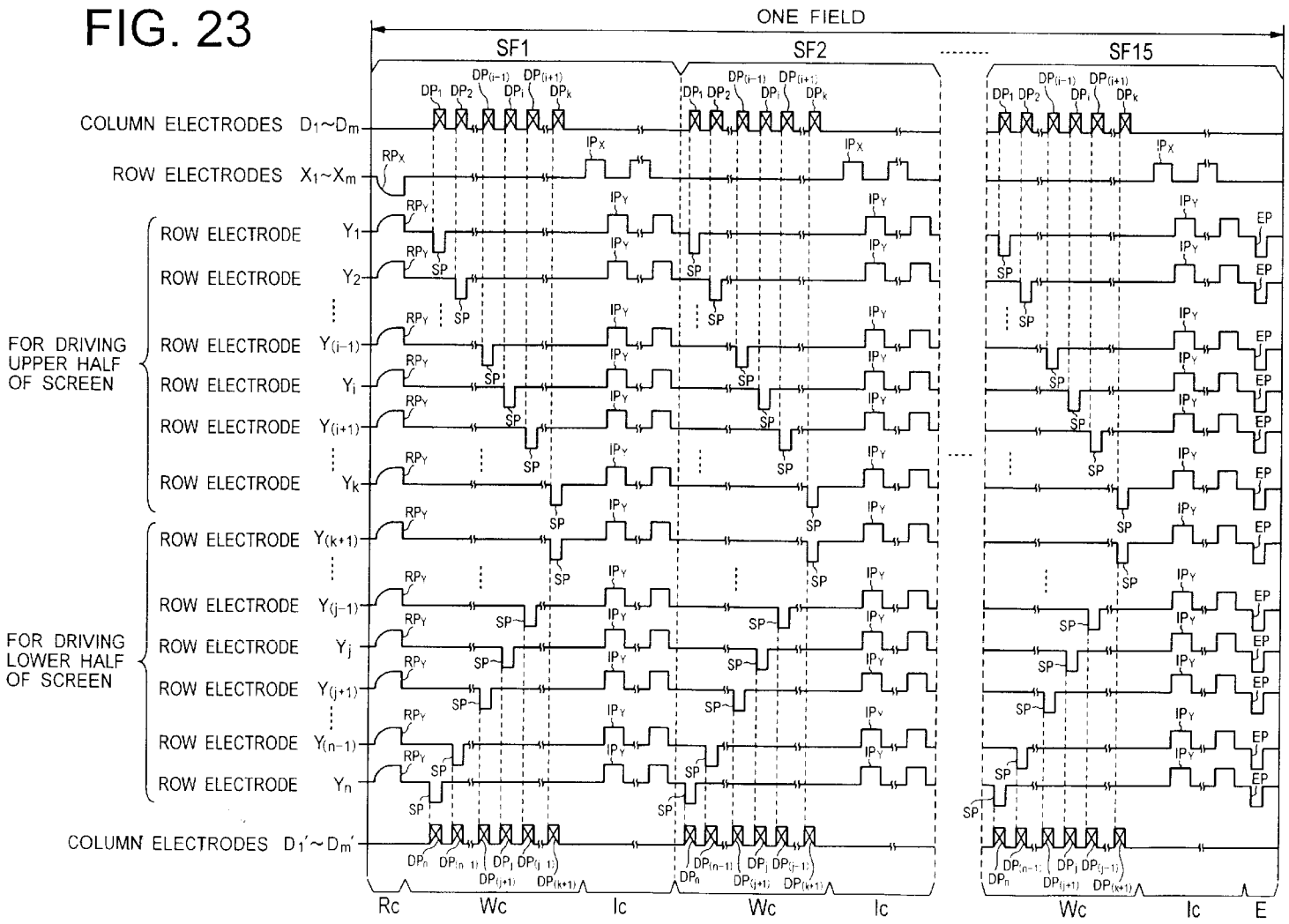
FIG. 23 is a waveform diagram showing application timings at which a variety of driving pulses are applied to the PDP 10 in accordance with the first light emission driving format illustrated in FIG. 20.

FIG. 23 is a waveform chart showing application timings at which each of the above drivers applies the variety of driving pulses to the column electrodes and the row electrode pairs of the PDP 10' in accordance with the first light emission driving format illustrated in FIG. 20.

In FIG. 23, first, in the simultaneous reset process Rc of the first subfield SF1, each of the upper first sustain driver 71 and the lower first sustain driver 72 generates the reset pulse $RP_X$ of negative polarity, and simultaneously applies the reset pulse $RP_X$ to each of the row electrodes $X_1$–$X_n$. Simultaneously, each of the upper second sustain driver 81 and the lower second sustain driver 82 generates the reset pulse $RP_Y$ of positive polarity, and simultaneously applies the reset pulse $RP_Y$ to all the row electrodes $Y_1$–$Y_n$. The application of these reset pulses $RP_X$ and $RP_Y$ causes all the discharge cells in the PDP 10' to be reset or discharged to forcedly form a wall charge in each of the discharge cells. Such an operation initializes all the discharge cells in the PDP 10' to a "light emitting cell" state.

In each pixel data writing process Wc, each of the upper address driver 61 and the lower address driver 62 generates a pixel data pulse having a voltage corresponding to a logical level of the drive pixel data bit DB supplied from the memory 40. In this event, the drive pixel data bits $DB_{11}$–$DB_{km}$ corresponding to each of the first display line to the k-th display line in the upper half of the screen are read from the memory 40 every display line in the order of the first display line to the k-th display line within each of the drive pixel data bits $DB_{11}$–$DB_{nm}$. Therefore, the upper address driver 61 sequentially applies the column electrodes $D_1$–$D_m$ with pixel data pulse groups $DP_1$–$DP_k$, each comprised of m pixel data pulses, corresponding to each of the first display line to the k-th display line as shown in FIG. 23. Also, in parallel with the above read operation, the drive pixel data bits $DB_{(k+1)1}$–$DB_{nm}$ corresponding to each of the (k+1)th display line to the n-th display line in the lower half of the screen are read from the memory 40 every display line in the order of the n-th display line to the (k+1)th display line within each of the drive pixel data bits $DB_{11}$–$DB_{nm}$. Therefore, the lower address driver 62 sequentially applies the column electrodes $D_1'$–$D_m'$ with pixel data pulse groups $DP_n$–$DP_{k+1}$, each comprised of m pixel data pulses, corresponding to each of the n-th display line to the (k+1)th display line as shown in FIG. 23.

Further, in the pixel data writing process Wc, at the timing at which each of the pixel data pulse group $DP_1$–$DP_k$ is applied, the upper second sustain driver 81 generates the scanning pulse SP of negative polarity and sequentially applies the scanning pulse SP to the row electrodes $Y_i$–$Y_k$, as shown in FIG. 23. Simultaneously with the operation of applying the scanning pulse SP, the lower second sustain driver 82 generates the scanning pulse SP of negative polarity at the same timing at which each of the pixel data pulse groups $DP_n$–$DP_{(k+1)}$ is applied and sequentially applies the scanning pulse SP to the row electrodes $Y_n$–$Y_{(k+1)}$, as shown in FIG. 23.

In the pixel data writing process Wc, the discharge (selective writing discharge) occurs only in discharge cells at intersections of "rows" applied with the scanning pulse SP with "columns" applied with the pixel data pulse at a high voltage to extinguish the wall charges formed in the discharge cells. This selective writing discharge as described causes the discharge cells initialized to the "light emitting cell" state in the simultaneous reset process Rc to transition to the "non-light emitting cells." On the other hand, the selective writing discharge as described above does not occur in discharge cells which have been applied with the pixel data pulse at a low voltage, so that these discharge cells are maintained in the initialized state in the simultaneous reset process Rc, i.e., the "light emitting cell" state.

In the next light emission sustain process Ic, each of the upper first sustain driver 71, lower first sustain driver 72, upper second sustain driver 81, and lower second sustain driver 82 alternately applies the row electrodes $X_1$–$X_n$ and $Y_1$–$Y_n$ with sustain pulses $IP_X$ and $IP_Y$ of positive polarity as illustrated in FIG. 23. In this event, the number of times (period) the sustain pulses IP are applied in the light emission sustaining process Ic in each of the subfields SF1–SF15 as illustrated in FIG. 20 is two, as described in FIG. 20. Thus, the discharge cells in which the wall charges remain, i.e., the "light emitting cells" discharge to sustain light emission each time they are applied with the sustain pulses $IP_X$ and $IP_Y$ to sustain the light emitting state associated with the sustain discharge for the number of times (period) as mentioned above.

A sequence of operations involved in the pixel data writing process Wc and the light emission sustain process Ic are performed in each of the subfields SF1–SF15.

Then, in the erasure process E in the subfield SF15 at the end of one field, each of the upper second sustain driver 81 and the lower second sustain driver 82 applies the row electrodes $Y_1$–$Y_n$ with the erasure pulse EP. This result in the erasure discharge produced in all the discharge cells to completely extinguish the wall charges which have remained in the respective discharge cells.

As described above, a sequence of operations in the subfields SF1–SF15 are repetitively performed to provide a view at an intermediate luminance corresponding to a total number of times of sustain discharges produced in the light emission sustain process Ic in each of the subfields SF. In this event, whether or not the sustain discharge as described above is produced in the light emission sustain process Ic in each subfield is determined depending on whether or not the selective erasure discharge is produced in the pixel data writing process Wc in the subfield. Here, according to drive pixel data GD in FIG. 18, the selective erasure discharge is produced in the pixel data writing process Wc only in one of the subfields SF1–SF15 within one field, as indicated by black circles in FIG. 18. Therefore, the wall charges formed in the simultaneous reset process Rc in the first subfield SF1 remain until the selective erasure discharge occurs, thereby allowing each of the discharge cells to sustain the "light emitting cell" state. In other words, the sustain discharge, causing light emission, is produced in the light emission sustain process Ic in each of the subfields (indicated by white circles) intervening therebetween.

Therefore, according to the gradation driving sequence in accordance with the first light emission driving format illustrated in FIG. 20 using the drive pixel data GD illustrated in FIG. 18, an intermediate display luminance representation can be provided at 16 gradation levels, each of which has the following luminance:

{0, 2, 4, 6, 8, 10, 12, 14, 16, 18, 20, 22, 24, 26, 28, 30}.

Alternatively, when the plasma display panel is supplied with a video signal corresponding to an image having a black display region (indicated by hatchings) in one screen as represented by the image PC2, the drive control circuit 20 selects the second light emission driving format illustrated in FIG. 21 from the formats illustrated in FIGS. 20 to 22.

Figure 24:
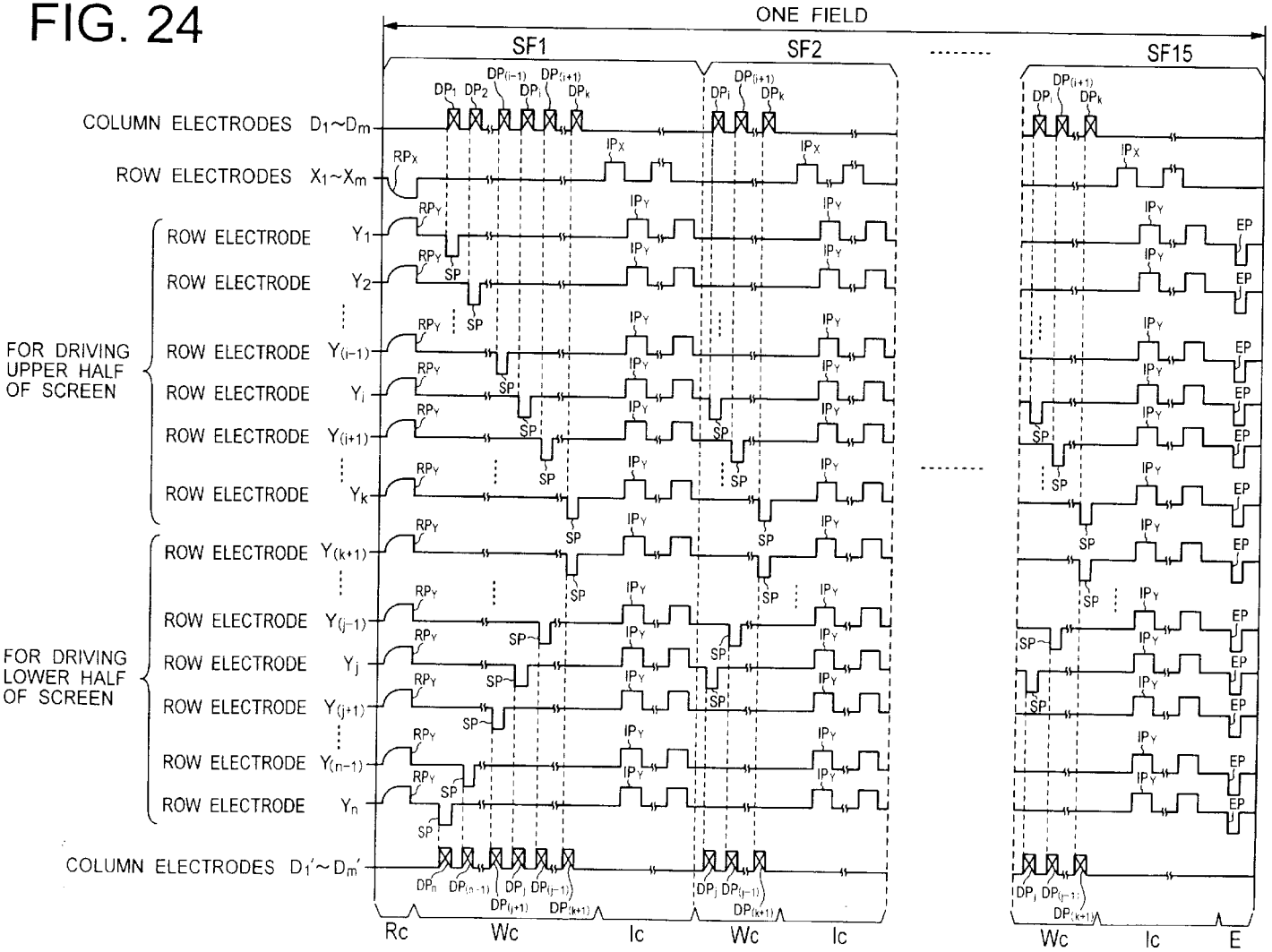
FIG. 24 is a waveform diagram showing application timings at which a variety of driving pulses are applied to the PDP 10' in accordance with the second light emission driving format illustrated in FIG. 20 and the third light emission driving format illustrated in FIG. 22.

FIG. 24 is a waveform chart showing application timings at which a variety of driving pulses are applied to the column electrodes and the row electrode pairs of the PDP 10' in accordance with the second light emission driving format illustrated in FIG. 21. Since the timings at which the driving pulses are applied in the simultaneous rest process Rc and the pixel data writing process Wc within the subfield SF1 in FIG. 24 are identical to those shown in FIG. 23, description thereon is omitted.

First, in the pixel data writing process Wc in each of the subfields SF2–SF15, the drive control circuit 20 detects display lines belonging to a black display region based on the black display region discriminating signal EZ. Then, the drive control circuit 20 stops supplying the variety of drivers as mentioned above with a timing signal for prompting them to apply each of the display lines belonging to the black display region with the scanning pulse SP and the pixel data pulse groups DP. Therefore, when the plasma display panel is supplied with a video signal corresponding to an image as represented by the image PC2, the upper address driver 61 sequentially applies the column electrodes $D_1$–$D_m$ only with the pixel data pulse groups $DP_i$–$DP_k$ from among the pixel data pulse groups $DP_1$–$DP_k$ corresponding to each of the first display line to the k-th display line, except for $DP_1$–$DP_{(i-1)}$, as shown in FIG. 24. The lower address driver 62 in turn sequentially applies the column electrodes $D_1'$–$D_m'$ only with the pixel data pulse groups $DP_j$–$DP_{(k+1)}$ from among the pixel data pulse groups $DP_n$–$DP_{(k+1)}$ corresponding to each of the n-th display line to the (k+1)th display line, except for $DP_n$–$DP_{(j+1)}$, as shown in FIG. 24.

Further, in the pixel data writing process Wc, at the timing at which each of the pixel data pulse group $DP_1$–$DP_k$ is applied, the upper second sustain driver 81 generates the scanning pulse SP of negative polarity and sequentially applies the scanning pulse SP to the row electrodes $Y_i$–$Y_k$, as shown in FIG. 24. Additionally, in parallel with the operation of applying the scanning pulse SP, the lower second sustain driver 82 generates the scanning pulse SP of negative polarity at the same timing at which each of the pixel data pulse groups $DP_j$–$DP_{(k+1)}$ is applied and sequentially applies the scanning pulse SP to the row electrodes $Y_j$–$Y_{(k+1)}$, as shown in FIG. 24.

In the pixel data writing process Wc, the selective erasure discharge occurs only in discharge cells at intersections of "rows" applied with the scanning pulse SP with "columns" applied with the pixel data pulse at a high voltage to extinguish the wall charges formed in the discharge cells. This selective erasure discharge as described causes the discharge cells initialized to the "light emitting cell" state in the simultaneous reset process Rc to transition to the "non-light emitting cells." On the other hand, the selective writing discharge as described above does not occur in discharge cells which have been applied with the pixel data pulse at a low voltage, so that these discharge cells are maintained in the initialized state in the simultaneous reset process Rc, i.e., the "light emitting cell" state.

Then, in each light emission sustain process Ic, each of the upper first sustain driver 71, lower first sustain driver 72, upper second sustain driver 81, and lower second sustain driver 82 alternately applies the row electrodes $X_1$–$X_n$ and $Y_1$–$Y_n$ with sustain pulses $IP_X$ and $IP_Y$ of positive polarity as illustrated in FIG. 24. In this event, the number of times the sustain pulses IP are applied in the light emission sustaining process Ic in each of the subfields SF1–SF15 is four, as described in FIG. 21. Thus, the discharge cells in which the wall charges remain, i.e., the "light emitting cells" discharge to sustain light emission each time they are applied with the sustain pulses $IP_X$ and $IP_Y$ to sustain the light emitting state associated with the sustain discharge for the number of times as mentioned above.

A sequence of operations involved in the pixel data writing process Wc and the light emission sustain process Ic are performed in each of the subfields SF2–SF15.

Then, only in the erasure process E in the subfield SF15 at the end of one field, each of the upper second sustain driver 81 and the lower second sustain driver 82 applies the row electrodes $Y_1$–$Y_n$ with the erasure pulse EP as shown in FIG. 24. This results in the erasure discharge produced in all the discharge cells to completely extinguish the wall discharges which have remained in the respective discharge cells.

As described above, a sequence of operations in the subfields SF1–SF15 illustrated in FIG. 21 are repetitively performed to provide a view at an intermediate luminance corresponding to a total number of times of sustain discharges produced in the light emission sustain process Ic in each of the subfields SF. In this event, whether or not the sustain discharge as described above is produced in the light emission sustain process Ic in each subfield is determined depending on whether or not the selective erasure discharge is produced in the pixel data writing process Wc in the subfield. Here, according to the drive pixel data GD in FIG. 18, the selective erasure discharge is produced in the pixel data writing stage Wc only in one of the subfields SF1–SF15 within one field, as indicated by black circles in FIG. 18. Therefore, the wall charges formed in the simultaneous reset process Rc in the first subfield SF1 are held until the selective erasure discharge occurs, thereby prompting each of the discharge cells to emit light in the light emission sustain process Ic in each of the subfields (indicated by white circles) intervening therebetween. In this event, the wall charge is extinguished once the selective erasure discharge is produced, so that no light is emitted in any of the light emission sustain processes Ic subsequent thereto. Here, all pixel data PD corresponding to the black display regions (first to i-th display lines and j-th to n-th display lines) indicated by hatchings in the image PC2 have a luminance level "0." Therefore, once the selective erasure discharge is produced in the subfield SF1 as illustrated in FIG. 21, pixel data need not be written into the first to i-th display lines and the j-th to n-th display lines included in the black display regions in the subfields subsequent thereto. Since this results in a reduction in time spent for each pixel data writing process Wc in each of the subfields SF2–SF15 in FIG. 21, the number of times of light emission allocated to each light emission sustain process Ic is increased to "4," as shown in FIG. 21, by the reduction in time for the pixel data writing process Wc.

Therefore, according to the gradation driving sequence in accordance with the second light emission driving format illustrated in FIG. 21 using the drive pixel data GD illustrated in FIG. 18, an intermediate display luminance representation can be provided at 16 gradation levels, each of which has the following luminance, higher than those provided by the gradation driving in accordance with the first light emission driving format illustrated in FIG. 20:

{0, 4, 8, 12, 16, 20, 24, 28, 32, 36, 40, 44, 48, 52, 56, 60}.

Alternatively, when the plasma display panel is supplied with a video signal corresponding to an image having a black display region JZ including a caption in one screen as represented by the image PC3, the gradation driving is performed in accordance with the third light emission driving format as illustrated in FIG. 22.

In the third light emission driving format, since the operations in each of the subfields SF1–SF7 and SF9–SF15, except for the subfield SF8, are identical, description thereon is omitted.

In the pixel data writing process Wc in the subfield SF8 in the third light emission driving format, pixel data is written into all the display lines in a manner similar to the subfield SF1 to stop light emission associated with a display of a caption at this time. In this event, pixel data PD representing the black display region JZ including a caption as represented by the image PC3 is converted to 15-bit drive pixel data GD which has only a first bit set at logical level "1" or only an eighth bit set at logical level "1" in accordance with the data conversion table as shown in FIG. 19. Here, since pixel data PD corresponding to a portion free of the caption within the black display region JZ (a portion at luminance level "0") is "0000," the pixel data is converted to 15-bit drive pixel data GD which has only a first bit set at logical level "1" by the data conversion table shown in FIG. 19. Therefore, since the selective erasure discharge has been produced in the pixel data writing process Wc in the first subfield SF1, no sustain discharge is produced in the light emission sustain process Ic in any of the subfields SF1–SF15. In other words, the pixel data is in a black display state at luminance level "0." On the other hand, pixel data PD corresponding to the caption itself in the black display region JZ is other than "0000," the pixel data PD is converted to 15-bit drive pixel data GD which has only the eight bit set at logical level "1" by the data conversion table shown in FIG. 19. Thus, until the selective erasure discharge is produced in the subfield SF8 as indicated by a black circle in FIG. 19, a sustain discharge associated with light emission is produced in the light emission sustain process Ic in each of the subfields SF1–SF7, as indicated by white circles in FIG. 19. This results in the caption displayed at luminance level "28."

In this event, the pixel data writing process Wc in each of the subfields SF2–SF7 and SF9–SF15 omits the pixel data write operation for the black display region in a manner similar to the second light emission driving format illustrated in FIG. 21. Accordingly, the number of times of light emission allocated to each light emission sustain process Ic is increased to "4," similar to the second light emission driving format illustrated in FIG. 21, by the reduction in time for the pixel data writing process Wc, thereby providing a higher intermediate display luminance.

In the foregoing embodiment, a black display region included in one screen is detected based on an input image signal to stop a pixel data write operation for the detected black display region, thereby reducing a time required for performing each pixel data writing process Wc. Alternatively, the time required for performing each pixel data writing process Wc may be reduced by choosing a less number of gradation levels for previously set upper and lower display regions on the screen than a central display region at the center of screen.

Figure 25:
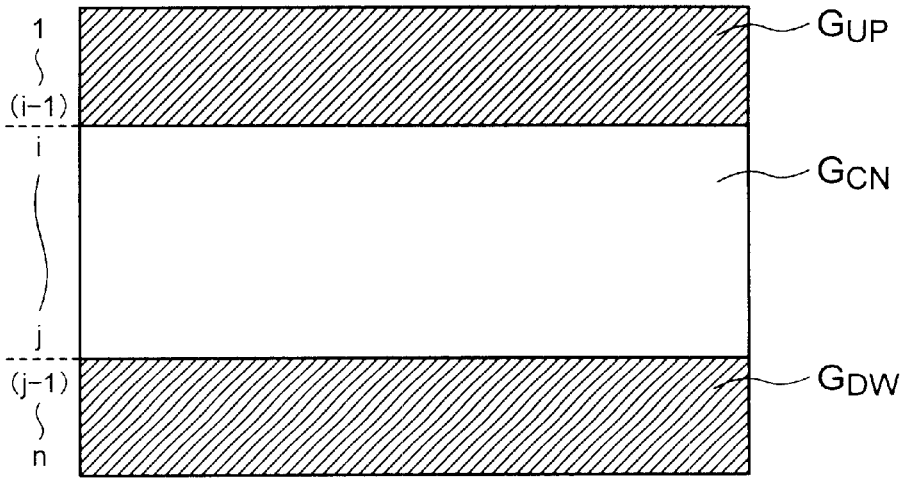
FIG. 25 is a diagram showing an upper display region $G_{UP}$ and a lower display region $G_{DW}$ in which low gradation number driving is performed, and a central display region $G_{CN}$ in which high gradation number driving is performed.

In this event, the data converting circuit 50 converts pixel data PD representative of an upper display region $G_{UP}$ and a lower display region $G_{DW}$ in a screen as illustrated in FIG. 25 to 15-bit drive pixel data GD in accordance with the data conversion table shown in FIG. 19. On the other hand, the data converting circuit 50 converts pixel data PD representative of a central display region $G_{CN}$ at the center in the screen as illustrated in FIG. 25 to 15-bit drive pixel data GD in accordance with the data conversion table shown in FIG. 18.

Then, the gradation driving is performed for the PDP 10', as shown in FIGS. 22 to 24.

According to the driving sequence as described, for the central display region $G_{CN}$ at the center of the screen as illustrated in FIG. 25, the plasma display device is driven to provide a display with a larger number of gradation levels equal to 16 as follows:

{0, 4, 8, 12, 16, 20, 24, 28, 32, 36, 40, 44, 48, 52, 56, 60}

On the other hand, the upper display region $G_{UP}$ and the lower display region $G_{DW}$ in the screen as illustrated in FIG. 25, the plasma display device is driven to provide a display with a smaller number of gradation levels equal to two as follows:

{0, 28}

In other words, for an image whose central display region is only to be monitored, the number of gradation levels is reduced for an upper and a lower display region on the screen to reduce a time required for performing each pixel data writing process Wc. Thus, the number of times light is emitted for the central display region is increased by the reduction in the time for the pixel data writing process Wc to realize a high luminance display.

Alternatively, the plasma display device may be configured such that the high luminance number driving is performed for the central display region as described above, while a first driving sequence for performing the low gradation number driving and a second driving sequence for driving the entire screen with the same number of gradation levels as shown in FIGS. 20 to 22 may be selectively performed for the upper and lower display regions in accordance with a manipulation of the user. Further alternatively, the plasma display device may be configured such that the first driving sequence is performed when it is supplied with a video signal representative of an image which includes black display regions, as mentioned above, in an upper and a lower portion of the screen, while the second driving sequence is automatically performed when it is supplied with a video signal representative of an image which does not include any black display region.

Also, in the foregoing embodiment, pixel data of every display line is sequentially written into each of display lines belonging to a black display region as represented by the image PC3 or to the upper display region $G_{UP}$ and the lower display region $G_{DW}$ in FIG. 21. However, since these upper display region $G_{UP}$ and lower display region $G_{DW}$ as well as the black display region do not require a high image quality, the same pixel data may be used so that the pixel data is simultaneously written into a plurality of display lines.

Figure 26:
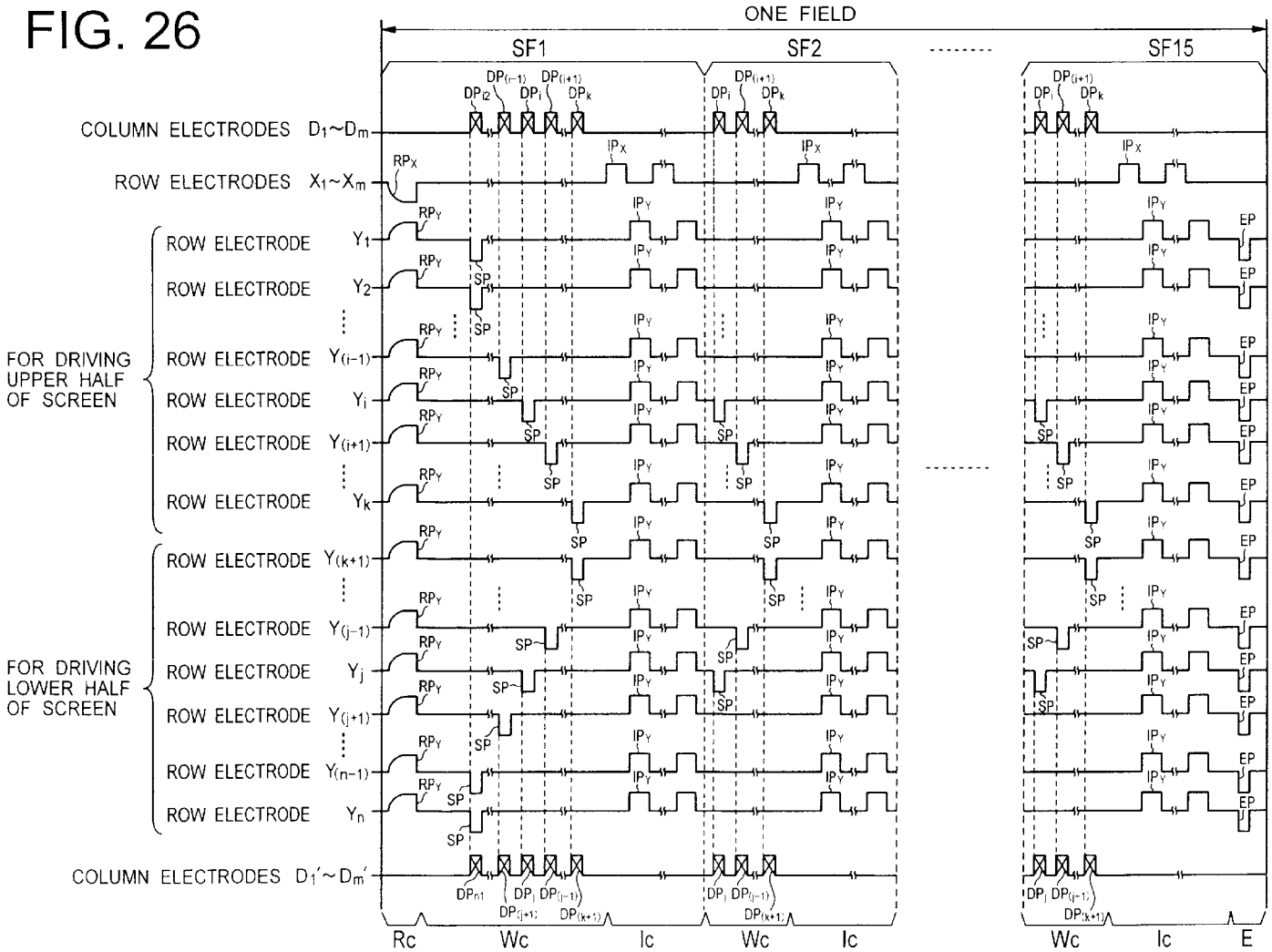
FIG. 26 is a waveform diagram showing an exemplary modification to the driving scheme shown in FIG. 25.

FIG. 26 is a waveform chart showing an exemplary driving method which is modified in view of the aspect mentioned above.

In FIG. 26, pixel data is simultaneously written into a first and a second display line belonging to an upper display region $G_{UP}$, using a pixel data pulse $DP_{12}$, in the pixel data writing process Wc in the subfield SF1. Also, pixel data is simultaneously written into an n-th and an (n−1)th display line belonging to the lower display region $G_{DW}$, using a pixel data pulse $DP_{n1}$.

According to this driving method, it is possible to further reduce the time required for the pixel data writing process Wc.

Also, in the foregoing embodiment, the time required for performing the pixel data writing process Wc is reduced by stopping a select operation for setting discharge cells belonging to a black display line or a low gradation level number driven line into the "light emitting cell" state or the "non-light emitting cell" state, or collectively setting the discharge cells into the "non-light emitting cell" state. Then, the number of times of light emission allocated to the light emission sustain process Ic in each subfield is increased by the reduction in time. Alternatively, the number of subfields allocated to one field display period may be increased in accordance with the reduction in time to increase the number of display gradation levels for a higher image quality.

For example, in place of the second driving format which divides one field display period into four subfields as illustrated in FIG. 8, a light emission driving format is employed to divide one field period into five subfields SF1–SF5, in accordance with the reduction in time, in which light is emitted in each light emission sustain process Ic the following numbers of times:

SF1: 1
SF2: 2
SF3: 4
SF4: 8
SF5: 16

In this way, since an increase in the number of subfields resulting from the utilization of the reduction in time provides an increased number of display gradation levels, the image quality can be improved.

As described above in detail, in the present invention, pixel data of every display line is sequentially written into pixel cells on display lines belonging to a region other than a black display region on the screen, while the writing of pixel data is stopped for pixel cells on display lines belonging to the black display region, or the pixel cells are simultaneously set into the non-light emitting cell state.

Therefore, according to the present invention, since a time spent for each pixel data writing process in one field is reduced, the quality of a displayed image can be improved by increasing a light emission period (number of times) allocated to each light emission sustain process or by increasing the number of subfields in one field by the reduction in time.

What is claimed is:

1. A display panel driving method for driving a display panel having pixel cells formed at each of intersections of a plurality of row electrodes corresponding to display lines with a plurality of column electrodes arranged to intersect said row electrodes to provide a display in gradation representation in accordance with a video signal, said method comprising:

performing, in each of a plurality of divided display periods of a unit display period in said video signal, a pixel data writing process for setting each of said pixel cells to either a light emitting cell or a non-light emitting cell in accordance with pixel data corresponding to said video signal to write the pixel data, and a light emission sustain process for causing only said light emission cells to emit light a number of times of light emission allocated thereto corresponding to a weighting factor applied to each of said divided display periods;

sequentially writing said pixel data of every display line into each of said pixel cells on display lines belonging to a first display region in a display screen on said display panel; and stopping writing said pixel data into each of said pixel cells on display lines belonging to a second display region in said display screen, or simultaneously setting said pixel cells into said non-light emitting cell.

2. The display panel driving method according to claim 1, wherein said second display region is a black display region in which a luminance level on display lines is zero.

3. The display panel driving method according to claim 2, wherein said black display region exists in an upper portion and a lower portion of said display screen.

4. The display panel driving method according to claim 2, wherein said black display region existing in said display screen is detected based on said video signal.

5. The display panel driving method according to claim 1, wherein the number of times of light emission in each of said divided display periods is increased, or the number of said divided display periods in said unit display period is increased corresponding to a blank time in said unit display time produced by stopping writing said pixel data or simultaneously setting said pixel cells into said non-light emitting cells.

6. A display panel driving method for driving a display panel having pixel cells formed at each of intersections of a plurality of row electrodes corresponding to display lines with a plurality of column electrodes arranged to intersect said row electrodes to provide a display in gradation representation in accordance with a video signal, said method comprising:

performing, in each of a plurality of divided display periods divided from a unit display period in said video signal, a pixel data writing process for setting each of said pixel cells to either a light emitting cell or a non-light emitting cell in accordance with pixel data corresponding to said video signal to write the pixel data, and a light emission sustain process for causing only said light emission cells to emit light a number of times of light emission allocated thereto corresponding to a weighting factor applied to each of said divided display periods, wherein said method alternatively performs:

a first driving sequence for sequentially writing said pixel data of every display line into all said pixel cells in said display panel; or a second driving sequence for sequentially writing said pixel data of every display line into each of said pixel cells on display lines belonging to a first display region in a display screen on said display panel, and for stopping writing said pixel data into each of said pixel cells on display lines belonging to a second display region in said display screen or simultaneously setting said pixel cells into said non-light emitting cell.

7. The display panel driving method according to claim 6, wherein said second display region is a black display region in which a luminance level on display lines is zero.

8. The display panel driving method according to claim 7, wherein said black display region exists in an upper portion and a lower portion of said display screen.

9. The display panel driving method according to claim 7, wherein said black display region existing in said display screen is detected based on said video signal.

10. The display panel driving method according to claim 6, wherein said method performs said second driving sequence when said video signal represents an image which includes a black display region having a luminance level equal to zero in an upper portion and a lower portion of said display screen, and performs said first driving sequence when said video signal represents an image which does not include said black display region.

11. The display panel driving method according to claim 10, wherein, upon performing said second driving sequence, the number of times of light emission in each of said divided display periods is increased, or the number of said divided display periods in said unit display period is increased corresponding to a blank time in said unit display time produced by stopping writing said pixel data or simultaneously setting said pixel cells into said non-light emitting cells.

* * * * *